US006874205B1

(12) United States Patent
Savicki

(10) Patent No.: US 6,874,205 B1
(45) Date of Patent: Apr. 5, 2005

(54) CLOSURE DEVICE

(75) Inventor: Alan F. Savicki, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 09/980,444

(22) PCT Filed: Jun. 10, 1999

(86) PCT No.: PCT/US99/13216

§ 371 (c)(1),
(2), (4) Date: Nov. 14, 2001

(87) PCT Pub. No.: WO00/76349

PCT Pub. Date: Dec. 21, 2000

(51) Int. Cl.[7] ..... A44B 19/16

(52) U.S. Cl. ..... 24/30.5 R; 24/400; 24/430; 383/64

(58) Field of Search ..... 24/399, 415, 400, 24/416, 427, 30.5 R, 585.11, 585.12, DIG. 50, DIG. 39, 403; 383/64, 69; 53/133.4, 139.2; 493/213, 215, 927

(56) References Cited

U.S. PATENT DOCUMENTS

| | | | | | |
|---|---|---|---|---|---|
| 3,198,228 | A | | 8/1965 | Naito | |
| RE28,969 | E | | 9/1976 | Naito | |
| 4,199,845 | A | | 4/1980 | Ausnit | |
| 4,736,496 | A | | 4/1988 | Fisher et al. | |
| 4,922,586 | A | * | 5/1990 | Robson | 24/399 |
| 5,007,142 | A | | 4/1991 | Herrington | |
| 5,007,143 | A | * | 4/1991 | Herrington | 24/400 |
| 5,010,627 | A | | 4/1991 | Herrington et al. | |
| 5,020,194 | A | | 6/1991 | Herrington et al. | |
| 5,063,644 | A | | 11/1991 | Herrington | |
| 5,067,208 | A | | 11/1991 | Herrington et al. | |
| 5,070,583 | A | | 12/1991 | Herrington | |
| 5,088,971 | A | | 2/1992 | Herrington | |
| 5,131,121 | A | | 7/1992 | Herrington, Jr. et al. | |
| 5,161,286 | A | | 11/1992 | Herrington, Jr. et al. | |
| 5,189,764 | A | | 3/1993 | Herrington et al. | |
| 5,283,932 | A | | 2/1994 | Richardson et al. | |
| 5,301,394 | A | | 4/1994 | Richardson et al. | |
| 5,301,395 | A | | 4/1994 | Richardson et al. | |
| 5,363,540 | A | | 11/1994 | Dais et al. | |
| 5,426,830 | A | | 6/1995 | Richardson et al. | |
| 5,431,760 | A | | 7/1995 | Donovan | |
| 5,442,837 | A | | 8/1995 | Morgan | |
| 5,442,838 | A | | 8/1995 | Richardson et al. | |
| 5,448,808 | A | | 9/1995 | Gross | |
| 5,664,299 | A | * | 9/1997 | Porchia et al. | 24/400 |
| 5,896,627 | A | | 4/1999 | Cappel et al. | |
| 6,036,364 | A | * | 3/2000 | Heuvel | 383/64 |

FOREIGN PATENT DOCUMENTS

| | | | | |
|---|---|---|---|---|
| WO | WO 9823493 A1 | * | 6/1998 | B65D/33/25 |

* cited by examiner

*Primary Examiner*—James R. Brittain
(74) *Attorney, Agent, or Firm*—Thomas C. Feix

(57) ABSTRACT

A single-piece slider member (200) is provided for use with a closure device having interlocking fastening strips (108) disposed along opposing side walls (52, 53) of a storage container, such as a conventional plastic bag. The slider member (200) comprises a main body portion (210) which is adapted to be installed upon the interlocking fastening strips (108) and a door portion (240) which is hingedly attached to the main body portion (210) along a hinge portion (241) for movement between open and closed positions. When the main body portion (210) is installed upon the fastening strips (108), the hinge portion (241) is substantially perpendicular to the main body portion (210). The slider member (200) is also provided with a latching mechanism (280) which retains the door portion (240) in the closed position. During assembly, the main body portion (210) of the slider member (200) is installed upon the interlocking fastening strips (108) and then the door portion (240) is moved into the closed position to slidably attach the slider member (200) onto the interlocking fastening strips (108).

251 Claims, 11 Drawing Sheets

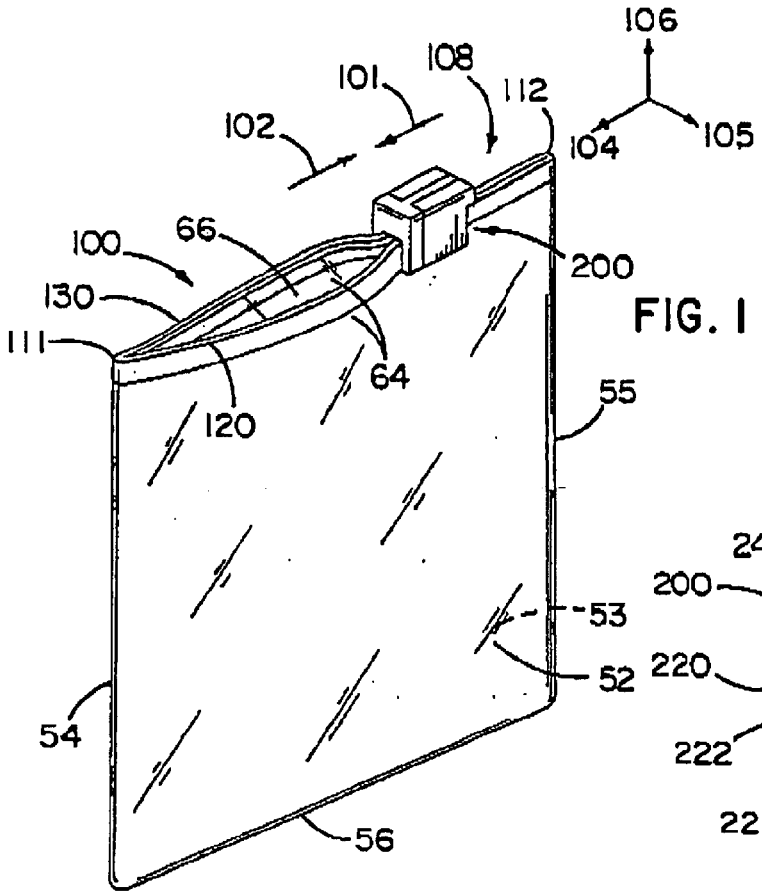
FIG. 1
FIG. 3
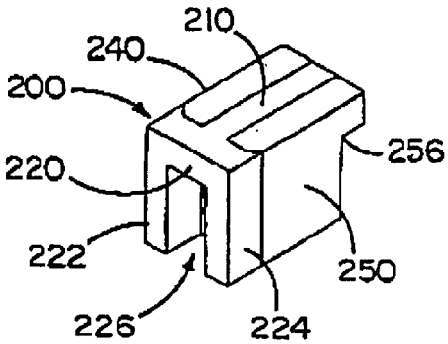
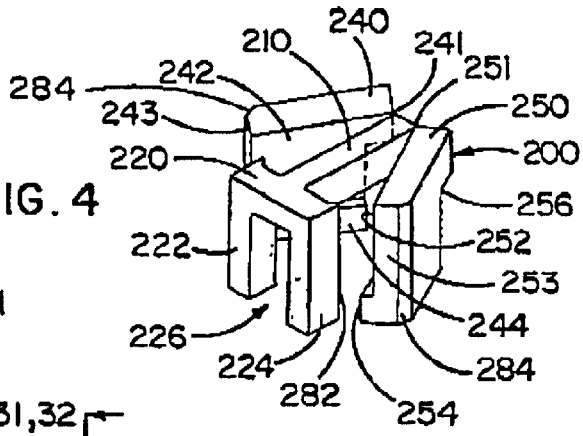
FIG. 4
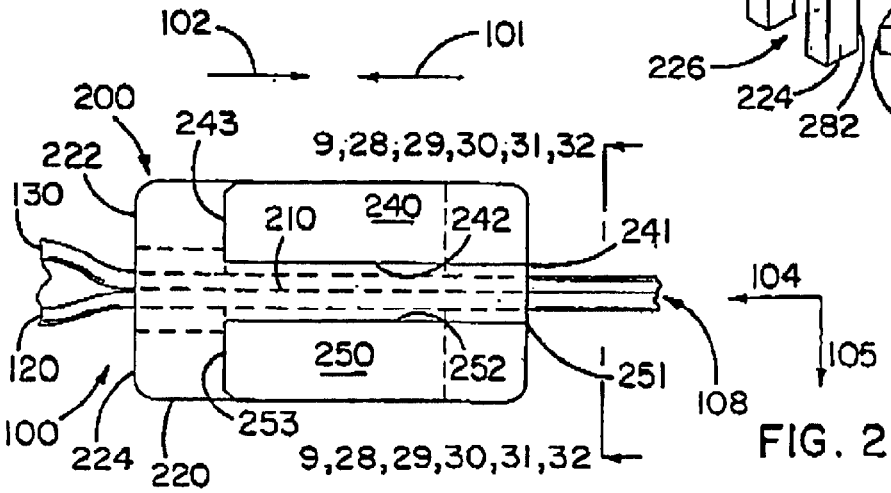
FIG. 2

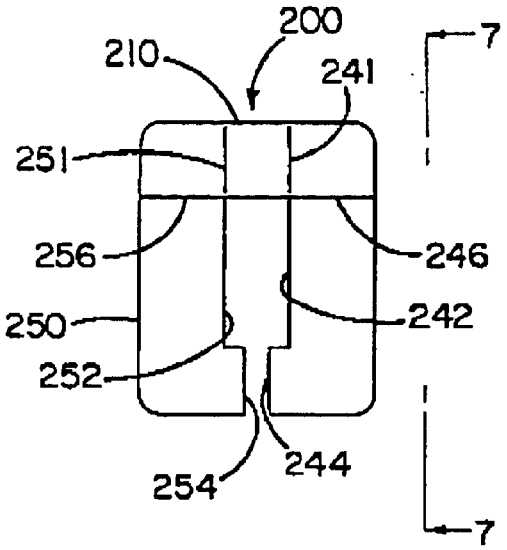
FIG. 6
FIG. 5
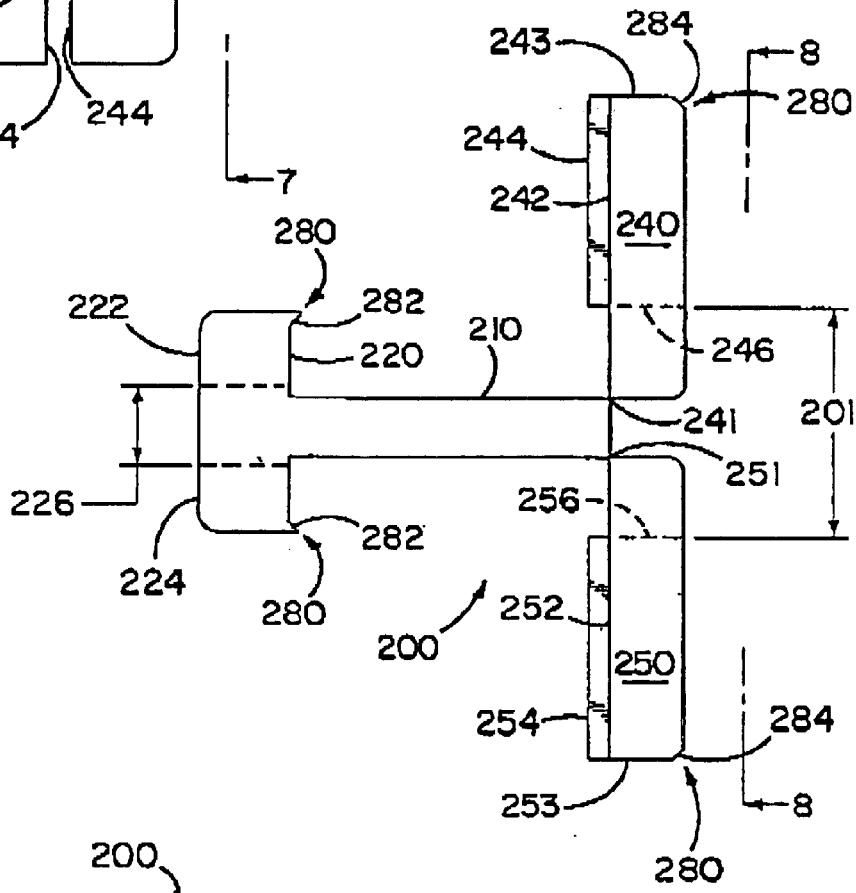
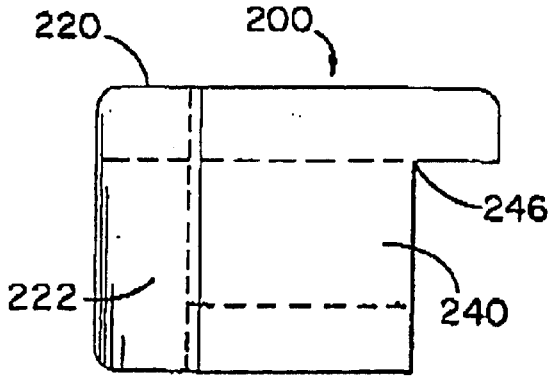
FIG. 7

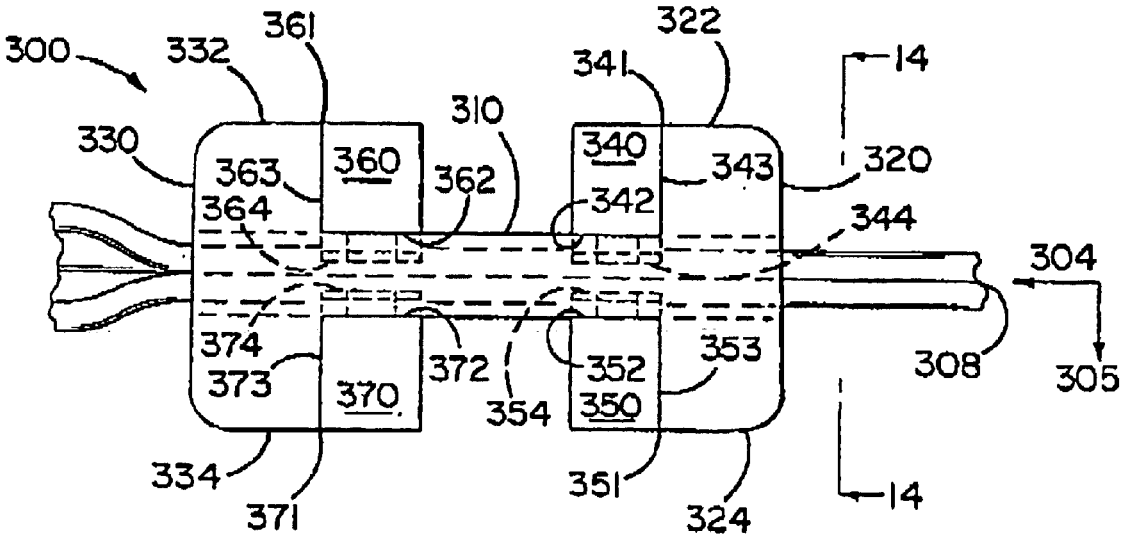
FIG. 10
FIG. 11
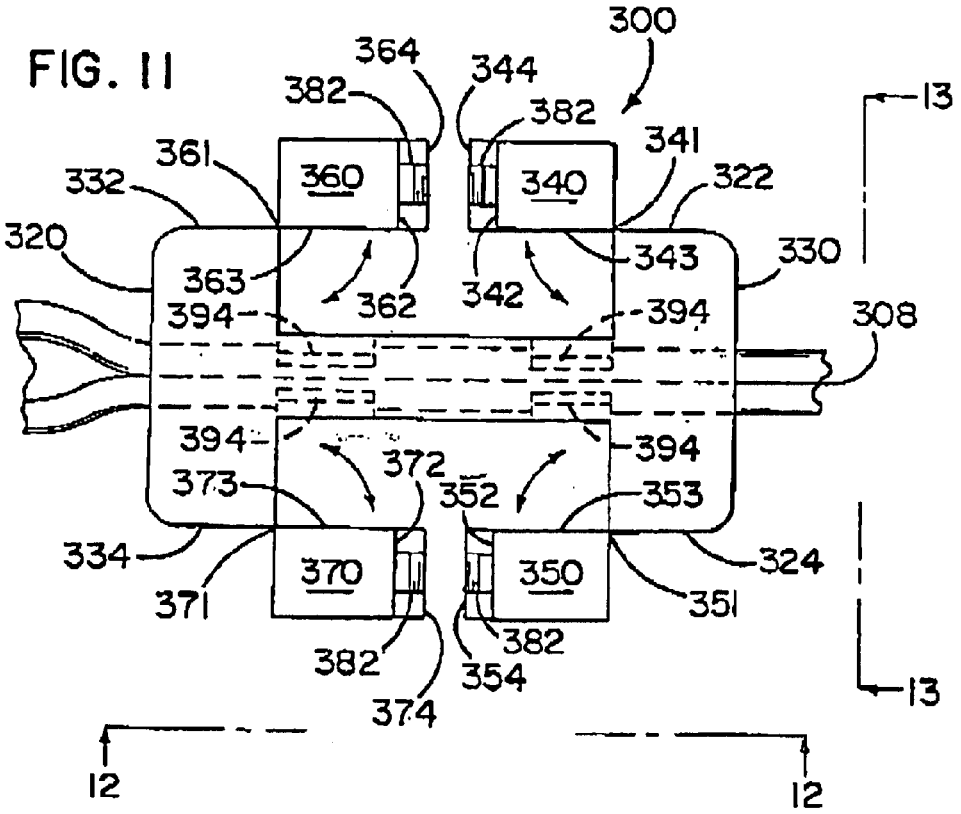

CLOSURE DEVICE

FIELD OF THE INVENTION

The present invention relates generally to closure devices and, more particularly, to a closure device comprised of interlocking fastening strips and a slider member. The inventive closure device may be employed in traditional fastener areas and is particularly well suited for fastening flexible storage containers, such as plastic bags.

BACKGROUND OF THE INVENTION

The use of closure devices for fastening storage containers, including plastic bags, is generally well known. Furthermore, the manufacture of closure devices made of plastic materials is generally well known to those skilled in the art, as demonstrated by the numerous patents in this area.

A particularly well-known use for closure devices is in connection with flexible storage containers, such as plastic bags. Such closure devices provide a convenient way to close the bag in order to retain matter therein.

Conventional closure devices typically utilize mating fastening strips or closure elements which are used to selectively seal the bag. With such closure devices, however, it is often difficult to determine whether the fastening strips are fully, occluded. This problem is particularly acute when the fastening strips are relatively narrow. Accordingly, when such fastening strips are employed, there exists a reasonable likelihood that the closure device is at least partially open.

Such fastening strips are particularly difficult to manipulate or handle by individuals with limited manual dexterity. Thus, in order to assist these individuals and for ease of use by individuals with normal dexterity, the prior art has provided sliders for use in opening and closing the fastening strips, as disclosed, for example, in U.S. Pat. Nos. 4,199,845, 5,007,142, 5,007,143, 5,010,627, 5,020,194, 5,070,583, 5,283,932, 5,301,394, 5,426,830, 5,431,760, 5,442,838, and 5,448,808. Some of these sliders include a separator finger which extends at least partially between the fastening strips. When the slider is moved in the appropriate direction, the separator finger divides the fastening strips and opens and the bag.

While the use of a slider certainly facilitates the opening and closing of fastening strips, there are certain difficulties involved with installing and assembling the slider onto the fastening strips and with retaining the slider thereon. In an attempt to rectify some of these difficulties, the prior art has provided a variety of slider designs including various single-piece sliders, as disclosed, for example, in U.S. Pat. Nos. 5,010,627, 5,067,208, 5,070,583, and 5,448,808. Such single-piece sliders, however, suffer from assorted deficiencies including, for example, a relatively complex construction, a high relative cost, and a design which lends itself to difficult installation upon and assembly onto the fastening strips.

OBJECTS OF THE INVENTION

Accordingly, a general object of the present invention is to provide a slider member for closure devices which overcomes the deficiencies of the prior art.

A more specific object of the present invention is to provide a single-piece slider member for closure devices which is easily installed upon and assembled onto interlocking fastening strips.

A further object of the present invention is to provide a single-piece slider member which is convenient to use.

An additional another object of the present invention is to provide a single-piece slider member of the foregoing type which is relatively simple and economical in construction, and which lends itself to reliable operation and use.

SUMMARY OF THE INVENTION

Accordingly, a single-piece slider member is provided for use with a closure device having interlocking fastening strips disposed along opposing side walls of a storage container, such as a conventional plastic bag. The slider member comprises a main body portion which is adapted to be installed upon the interlocking fastening strips and a door portion which is hingedly attached to the main body portion along a hinge portion for movement between open and closed positions. When the main body portion of the slider member is installed upon the interlocking fastening strips, the hinge portion is substantially perpendicular thereto. The slider member is also provided with a latching mechanism which conveniently retains each of the door portions in the closed position. During assembly, the main body portion of the slider member is installed upon the interlocking fastening strips and then each door portion is moved into the closed position to slidably attach the slider member onto the interlocking fastening strips in a self-retaining manner.

These and other objects, features, and advantages of the present invention will become more readily apparent upon reading the following detailed description of the illustrated embodiments and upon reference to the accompanying drawings wherein:

BRIEF DESCRIPTION OF THE DRAWINGS

FIG. 1 is a perspective view of a storage container in the form of a plastic bag utilizing a closure device comprised of interlocking fastening strips and a slider member constructed in accordance with a first embodiment of the present invention;

FIG. 2 is a partially fragmentary, top plan view of the closure device depicted in FIG. 1;

FIG. 3 is a perspective view of the slider member depicted in FIGS. 1 and 2, with the storage container and the interlocking fastening strips removed for clarity;

FIG. 4 is a perspective view of the slider member depicted in, FIG. 3, but showing the door portions of the slider member in a partially open position;

FIG. 5 is a top plan view of the slider member depicted in FIGS. 3 and 4, but showing the door portions of the slider member in a more completely open position;

FIG. 6 is a rear end view of the slider member depicted in FIG. 3;

FIG. 7 is a side elevational view of the slider member as seen in the direction of line 7—7 of FIG. 6;

FIG. 10 is a partially fragmentary top plan view of a storage container utilizing a closure device comprised of interlocking fastening strips and a second embodiment of the slider member;

FIG. 11 is a partially fragmentary top plan view of the closure device depicted in FIG. 10, but showing the door portions of the slider member in an open position;

Figure 9:
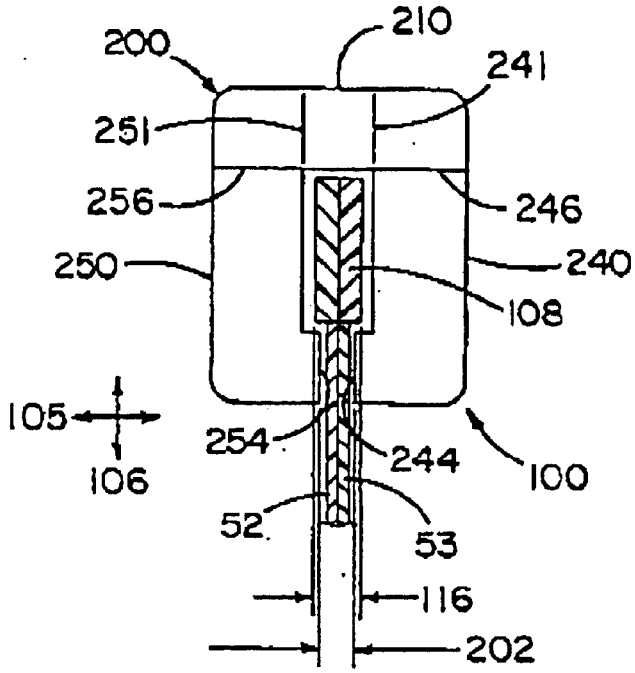
FIG. 9 is a rear end view of the closure device as seen in the direction of line 9—9 of FIG. 2, showing the slider member assembled onto interlocking fastening strips and the door portions in a closed position.

While the present invention is susceptible to various modifications and alternative constructions, certain illustrated embodiments thereof have been shown in the drawings and will be described in detail below. It should be understood, however, that there is no intention to limit the present invention to the disclosed structural forms. On the contrary, the intention is to cover all modifications, alternative constructions, and equivalents that fall within the spirit and scope of the present invention as defined by the appended claims.

DETAILED DESCRIPTION OF THE ILLUSTRATED EMBODIMENTS

Turning now to the drawings, a closure device constructed in accordance with the present invention is generally designated by reference numeral 100. As best shown in FIG. 1, the closure device 100 is intended for use with a storage container 50, such as a conventional plastic bag, which includes a pair of complementary sheets or opposing flexible side walls 52 and 53 attached at their lateral sides 54 and 55 and bottom 56 to form a storage compartment. The complementary sheets 52 and 53 are also unattached at their upper edge portions 64 to form a mouth 66 for the storage container 50. Although a rectangularly-shaped storage container or bag 50 is specifically illustrated herein, it will be readily appreciated by those skilled in the art that other bag configurations may alternatively be employed without departing from the scope or spirit of the present invention.

As shown in FIGS. 1 and 2, the closure device 100 includes a pair of interlocking fastening strips 108 which are disposed along the upper edge portions 64 of the opposing side walls 52 and 53. The closure device 100 also includes a single-piece slider member in accordance with the present invention which is slidably carried by the two fastening strips 108. More specifically, a first fastening strip 120 is attached to the upper edge portion 64 of one of the side walls 52, an affiliated second fastening strip 130 is attached to the upper edge portion 64 of the other side wall 53, and the inventive slider member slidably straddles both the first and second fastening strips 120 and 130. As will be described more fully below, five different embodiments of the inventive slider member 200, 300, 400, 500, and 600 are illustrated herein at FIGS. 1–9 and 10–14, 15, 16–20, and 21–27, respectively.

As will also be described more fully below, the interlocking fastening strips of the closure device may be of virtually any type, kind, version, or form including, for example: (1) U-channel closure strips as shown herein at FIG. 28; (2) shear action or Z-axis closure strips as shown herein at FIG. 29; (3) arrowhead-type closure strips, as disclosed in U.S. Pat. Nos. 3,198,228 (which reissued as Re. 28,969), 4,736,496, and 5,363,540 and as shown herein at FIG. 30; (4) rolling action closure strips, as disclosed in U.S. Pat. No. 5,007,143 and as shown herein at FIG. 31; and/or (5) profile closure strips, as disclosed in U.S. Pat. No. 5,664,299 and as shown herein at FIG. 32. All of the above-identified patents and applications are hereby incorporated by reference in their entireties.

In operation, the slider member 200 facilitates the occlusion of the interlocking fastening strips 108 when moved towards a first end 111 thereof, and facilitates the deocclusion of the interlocking fastening strips 108 when moved towards a second end 112 thereof. For example, when the slider member 200 is moved in an occlusion direction, as indicated by reference numeral 101 in FIGS. 1 and 2, it facilitates closure of the fastening strips 108. Conversely, when slider member 200 is moved in a deocclusion direction, as indicated by reference numeral 102 in FIGS. 1 and 2, it facilitates the separation of the fastening strips 108. The four other embodiments of the slider member 300, 400, 500, and 600 operate in an equivalent manner.

In order to facilitate a better understanding of the present invention, the closure device and each embodiment of the slider member 200, 300, 400, 500, and 600 will be described in connection with a traditional three dimensional coordinate system having an X-axis 104, a Y-axis 105, and a Z-axis 106. The X-axis 104 lies longitudinally along the interlocking fastening strips 108 and corresponds to the occlusion direction 101. The Y-axis 105 is perpendicular to the X-axis 104 and extends in a direction perpendicular to the opposing side walls 52 and 53 of the storage container 50 when the side walls 52 and 53 are in a relaxed state, as shown, for example, in FIG. 1. The Z-axis 106 extends perpendicularly upwardly from the plane created by the X-axis 104 and the Y-axis 105 in a vertical direction.

As shown in FIGS. 1–9, the first embodiment of the slider member 200 includes a main body portion 210 which is adapted to be positioned upon and installed along the interlocking fastening strips 108. The main body portion 210 of the slider member 200 further includes a transverse body segment or saddle 220 which is provided with a pair of spaced-apart and downwardly extending side members 222 and 224 with a slot or opening 226 therebetween. The main body portion 210 and the transverse body segment 220 have a generally T-shaped configuration when viewed from above, as shown in FIGS. 1–5. The transverse body segment 220 has an inverted U-shaped configuration when viewed from the front, as shown in FIGS. 3 and 4.

The slider member 200 is also provided with a pair of door portions 240 and 250 which are integrally hingedly attached to opposite sides of the main body portion 210 along respective hinge portions 241 and 251. The two door portions 240 and 250 each have a first side surface 242 and 252, respectively, a second side surface 243 and 253, respectively, and a shoulder 244 and 254, respectively. The shoulder 244, 254 is formed on a lower end of the first side surface 242 and 252. As shown in FIGS. 6 and 9, the shoulders 244 and 254 provide the door portions 240 and 250 with either an L-shaped or a reverse L-shaped configuration when viewed from the front or rear.

Figure 8:
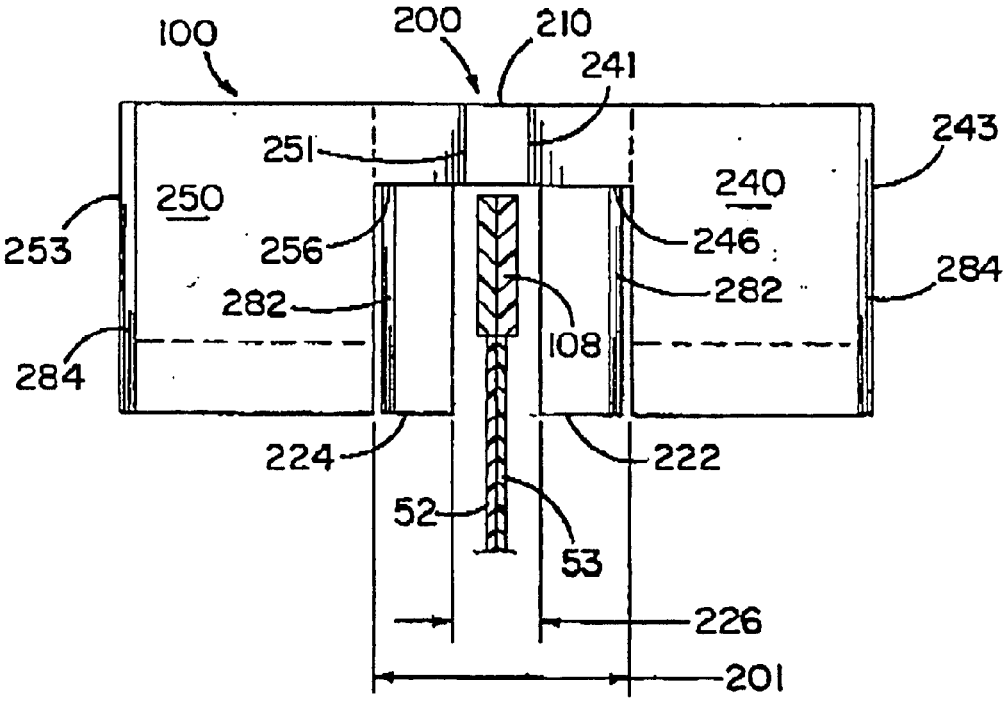
FIG. 8 is a rear end view of the slider member as seen in the direction of line 8—8 of FIG. 5, but showing the slider member installed upon interlocking fastening strips.

The integral hinge portions 241 and 251 of the slider member 200 are relatively thin sections of material which flexibly link the two door portions 240 and 250 to the main body portion 210 along substantially straight junction lines or seams. In the art of plastic molding, these hinge portions 241 and 251 are sometimes referred to as living hinges. In usage, these hinge portions 241 and 251 permit the door portions 240 and 250 to be moved between a closed position, as shown in FIGS. 1–3, and a multiplicity of open positions, including, for example, a first open position, as shown in FIGS. 5 and 8, and a second open position, as shown in FIG. 4.

In each of the open positions, the first side surfaces 242 and 252 of the two door portions 240 and 250 are spaced-apart from the main body portion 210 (at locations away from the hinge portions 241 and 251), and the second side surfaces 243 and 253 do not engage the transverse body segment 220. For example, in the first open position, the first side surfaces 242 and 252 and shoulders 244 and 254 of the door portions 240 and 250 are substantially perpendicular to the main body portion 210, as shown in FIG. 5. In addition, the second side surfaces 243 and 253 of the door portions 240 and 250 do not engage the transverse body segment 220. Likewise, in the second open position, the first side surfaces 242 and 252 and shoulders 244 and 254 of the door portions 240 and 250 form an acute angle with the main body portion 210, as shown in FIG. 4, and the second side surfaces 243 and 253 of the door portions 240 and 250 still do not engage the transverse body segment 220.

In the closed position, however, the first side surfaces 242 and 252 of the door portions 240 and 250 are adjacent to the main body portion 210 along their full length, as shown in FIG. 2. Also, the second side surfaces 242 and 252 engage the transverse body segment 220. In addition, the shoulders 244 and 254 of the door portions 240 and 250 are arranged substantially parallel to the main body portion 210.

During assembly, the main body portion 210 of the slider member 200 is initially positioned upon the interlocking fastening strips 10B, with the opposed side members 222 and 224 of the transverse body segment 220 straddling the interlocking fastening strips 108 and the two door portions 240 and 250 in one of the open positions. In order to facilitate receipt of the slider member 200 by the interlocking fastening strips 108 when the door portions 240 and 250 are open, a notch 246 and 256 is provided at the rear end of each door portion 240 and 250. In particular, these notches 246 and 256 are proximal to the hinge portions 241 and 251 and are located on a lower section of the door portion 240 and 250. Thus, when the door portions 240 and 250 are in one of the open positions, as shown, for example, in FIGS. 5 and 8, the notches 246 and 256 provide a first gap 201 between the two door portions 240 and 250 which is large enough to freely receive the interlocking fastening strips 108. In addition, the opening 226 between the opposed side members 222 and 224 of the transverse body segment 220 is also large enough to freely receive the interlocking fastening strips 108. On account of this construction, the main body portion 210 of the slider member 200 may be freely installed upon the interlocking fastening strips 108 when the two door portions 240 and 250 are in one of the open positions, without interfering with the shoulders 244 and 254 of the door portions 240 and 250.

Once the slider member 200 has been installed upon the interlocking fastening strips 108 in this manner, the two door portions 240 and 250 are then moved into the closed position to assemble the slider member 200 onto the interlocking fastening strips 108. In the closed position, the first side surface 242 and 252 of each door portion 240 and 250 engages the main body portion 210 between its hinge portion 241 and 251 and its second side surface 243 and 253, as shown in FIG. 2. Also, the second side surface 243 and 253 abuts the transverse body segment 220. In addition, the shoulders 244 and 254 of the door portions 240 and 250 are separated by a second gap 202 which is less than the width 116 of the fastening strips 108, as shown, for example, in FIG. 9. As a consequence, the slider member 200 may not be removed from the interlocking fastening strips 108 when the door portions 240 and 250 are in the closed position.

In order to retain the door portions 240 and 250 in the closed position, the slider member 200 is also provided with a convenient latching mechanism. In the present embodiment, the latching mechanism 280 comprises protuberances 282 formed along opposed edges of the transverse body segment; 220 and cooperating chamfers 284 formed along opposed outside edges of the two door portions 240 and 250, as shown in FIG. 5. When the door portions 240 and 250 of the slider member 200 are moved into the closed position, the protuberances 282 of the latching mechanism 280 interlockingly engage the chamfers 284 of the latching mechanism 280, as shown in FIGS. 2 and 3, to retain the door portions 240 and 250 in the closed position.

While latching mechanism 280 provides a convenient means for retaining the two door portions 240 and 250 in the closed position, those skilled in the art will readily appreciate that other means for retaining the door portions 240 and 250 in the closed position may alternatively be employed without departing from the scope or spirit of the present invention. For example, the door portions 240 and 250 may be retained in the closed position by welding the door portions 240 and 250 to either the main body portion 210 or to the transverse body segment 220. In another example, the door portions 240, 250 may be retained by providing a compression-type latch between the door portions 240 and 250 and either the main body portion 210 or the transverse body segment 220.

Once the slider member 200 has been slidably assembled onto the interlocking fastening strips 108, as shown, for example, in FIGS. 1 and 2, the main body portion 210 is positioned above the interlocking fastening strips 108 in a substantially parallel manner with respect to the X-axis 104. In addition, the transverse body segment 220 is substantially parallel to the Y-axis 105, and the hinge portions 241 and 251 are substantially parallel to the Z-axis 106. Also, the side walls 242 and 252 of the two door portions 240 and 250 are positioned on opposite sides of the interlocking fastening strips 108 in a substantially parallel manner with respect to the X-axis 104. Moreover, the side members 222 and 224 of the transverse body segment 220 are positioned on opposite sides of the interlocking fastening strips 108 in a substantially parallel manner with respect to the Z-axis 106.

Figure 30:
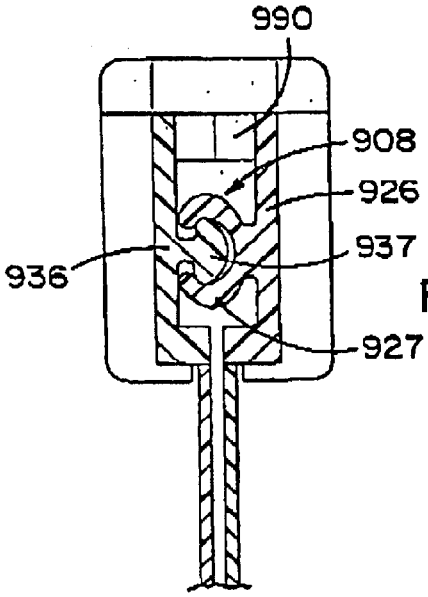
FIG. 30 is a cross-sectional view taken along line 30—30 in FIG. 2, but showing a third embodiment of the interlocking fastening strips.
Figure 31:
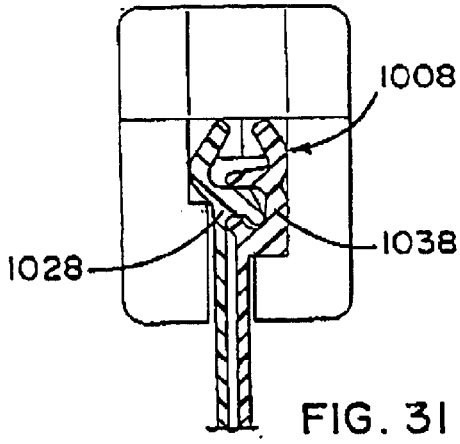
FIG. 31 is a cross-sectional view taken along line 31—31 in FIG. 2, but showing a fourth embodiment of the interlocking fastening strips.

As will be readily appreciated by those skilled in the art, the slider member 200 may also be provided with a separator finger which extends at least partially between the two interlocking fastening-strips, as shown, for example, in FIGS. 30 and 31. In use, this finger provides for the separation of the fastening strips when the slider member 200 is moved in the deocclusion direction 102, as disclosed in U.S. Pat. Nos. 5,007,142, 5,007,143, 5,010,627, 5,020,194, 5,067,208, 5,070,583, 5,088,971, 5,131,121, 5,161,286, 5,189,764, 5,282,932, 5,301,395, 5,426,830, 5,448,808, and 5,442,837.

Figure 12:
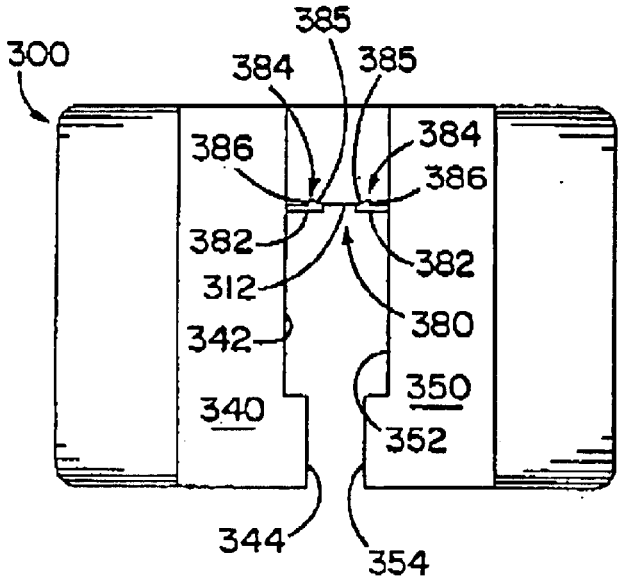
FIG. 12 is a side elevational view of the slider member as seen in the direction of line 12—12 of FIG. 11, but showing the storage container and the interlocking fastening strips removed for clarity.
Figure 13:
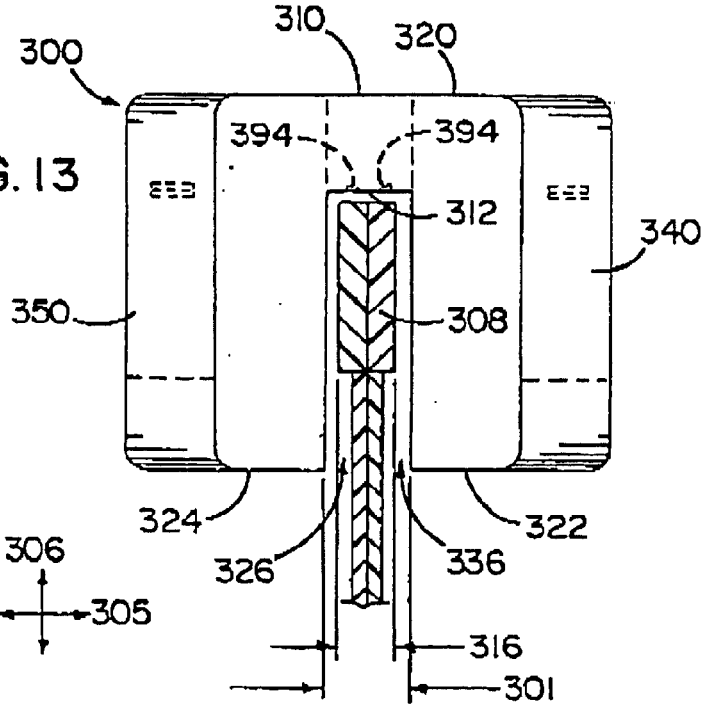
FIG. 13 is a rear end view of the slider member as seen in the direction of line 13—13 of FIG. 11, but showing the slider member installed upon interlocking fastening strips.
Figure 14:
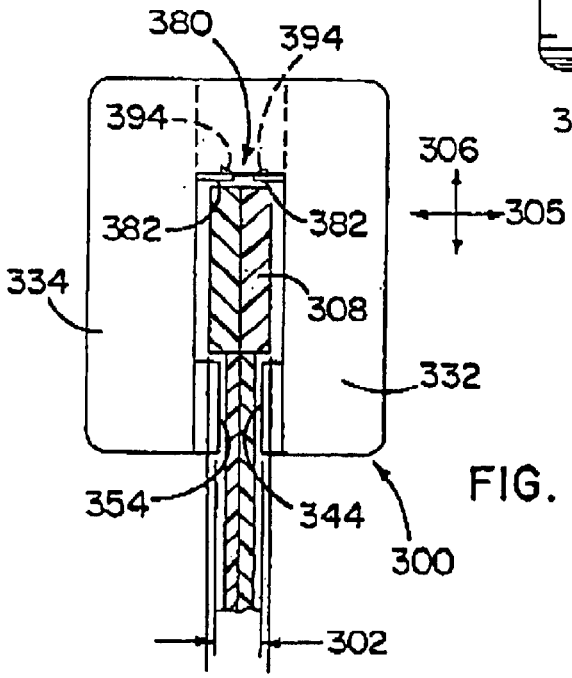
FIG. 14 is a rear end view of the closure device as seen in the direction of line 14—14 of FIG. 10, showing the slider member assembled onto interlocking fastening strips and the door portions of the slider member in a closed position.

The second embodiment of the inventive slider member 300 is shown in FIGS. 10–14. Like the first embodiment of, the slider member 200, the second embodiment of the slider member 300 includes a main body portion 310 which is adapted to be positioned upon and installed along the interlocking fastening strips 308. The main body portion 310 of the slider member 300 also includes a pair of transverse body segments or saddles 320 and 330 which are formed on opposite ends thereof and are arranged substantially perpendicular thereto. More specifically, the first transverse body segment 320 includes a pair of downwardly extending side members 322 and 324 with a slot or opening 326 therebetween. Similarly, the second transverse body segment 330 also includes a pair of downwardly extending side members 332 and 334 with a slot or opening 336 therebetween on account of this construction, the main body portion 310 and the two transverse body segments 320 and 330 of slider member 300 have a generally H-shaped configuration when viewed from above, as shown in FIGS. 10 and 11, and each transverse body segment 220 and 230 has an inverted U-shaped configuration when viewed from the front and rear, as shown in FIGS. 13 and 14.

The slider member 300 is also provided with two pairs of opposed door portions 340, 350, 360, and 370. The door portions 340, 350, 360, 370 which are integrally hingedly attached to opposite outer corners of the first and second transverse body segments 320 and 330 along respective hinge portions or living hinge structures 341, 351, 361, and 371. Like the two door portions 240 and 340 of the first embodiment, the four door portions 340, 350, 360, and 370 of the second embodiment each have a first side surface 342, 352, 362, and 372, respectively, a second side surface 343, 353, 363, and 373, respectively, and a shoulder 344, 354, 364, and 374, respectively. As shown in FIGS. 11 and 12, the shoulder 344, 354, 364, and 374 of each door portion 340, 350, 360, and 370 is formed on a lower end of the first side surfaces 342, 352, 362, and 372. In this way, the shoulders 344, 354, 364, and 374 provide the four door portions 340, 350, 360, and 370 with either an L-shaped or a reverse L-shaped configuration when viewed from the front or rear, as shown, for example, in FIGS. 12 and 14.

In use, the hinge portions 341, 351, 361, and 371 permit the four door portions 340, 350, 360, and 370 to be moved between a closed position, as shown in FIGS. 10 and 14, and a multiplicity of open positions including, for example, the open position shown in FIGS. 11–13. In each of the open positions, the first side surfaces 342, 352, 362, and 372 of the door portions 340, 350, 360, and 370 are spaced-apart from the main body portion 310, as shown, for example, in FIG. 11, and the second side surfaces 343, 353, 363, and 373 are spaced-apart from the transverse body segments 320 and 330 (at locations away from the hinge portions 341, 351, 361, and 371). In the closed position, conversely, the first side surfaces 342, 352, 362, and 372 of the door portions 340, 350, 360, and 370 are adjacent to the main body portion 310 and the second side surfaces 343, 353, 363, and 373 are adjacent to one of the transverse body segments 320 and 330. In addition, the shoulders 344, 354, 364, and 374 of the door portions 340, 350, 360, and 370 are substantially parallel to the main body portion 310, as shown in FIG. 10.

During assembly, the main body portion 310 of the slider member 300 is initially positioned upon the interlocking fastening strips 308, with the side members 322, 324, 332, and 334 of the two transverse body segments 320 and 330 straddling the interlocking fastening strips 308 and the four door portions 340, 350, 360, and 370 in one of the open positions. Because the hinge portions 341, 351, 361, and 371 are located at the outer corners of the transverse body segments 320 and 330, the door portions 340, 350, 360, and 370 may not require notches to facilitate receipt of the slider member 300 by the interlocking fastening strips 308 when the door portions 340, 350, 360, and 370 are open. Also, the openings 326 and 336 between the opposed side members 322, 324, 332, and 334 of the transverse body segments 320 and 330 are sized to receive the interlocking fastening strips 308. Thus, when the door portions are in an open position, the slider member 300 has a first gap 301 which is greater than the width 316 of the fastening strips 308, as shown in FIG. 13. As such, the main body portion 310 of the slider member 200 may be installed upon the interlocking fastening strips 308 when the door portions 340, 350, 360, and 370 are in the open position, without interfering with the shoulders 344, 354, 364, and 374 of the door portions 340, 350, 360, and 370.

Once the slider member 300 has been installed upon the interlocking fastening strips 308, the door portions 340, 350, 360, and 370 are then moved into the closed position to slidably assemble the slider member 300 onto the interlocking fastening strips 308. In the closed position, the first side surface 342, 352, 362, and 372 of each door portion 340, 350, 360, and 370 abuts the main body portion 310, as shown in FIG. 10. In addition, the second side surfaces 343, 353, 363, and 373 abuts one of the transverse body segments 320 and 330. Also, the opposed shoulders 344, 354, 364, and 374 of the door portions 340, 350, 360, and 370 are separated by a gap 302 (see FIG. 14) which is less than the width 316 of the interlocking fastening strips 308. On account of this construction, the slider member 300 may not be removed from the interlocking fastening strips 308 when the door portions 340, 350, 360, and 370 are in the closed position.

In order to retain the door portions 340, 350, 360, and 370 in the closed position as the slider member 300 is being installed upon and assembled onto the interlocking fastening strips 308, the slider member 300 is provided with latching mechanisms 380. In the present embodiment, each latching mechanism 380 comprises an appendage 382 projecting outwardly from the first side surface 342, 352, 362, and 372 of each door portion 340, 350, 360, and 370 and having a barb 384 at its distal end, together with a cooperating notch 394 formed in a lower surface 312 of the main body portion 310. As shown in FIG. 12, the appendages 382 of the latching mechanism 380 are substantially parallel to, but slightly offset from, the lower surface 312 of the main body portion 310. In addition, the barbs 384 of the appendages 382 each have a generally right-triangular configuration. More specifically, each barb 384 includes an inclined camming surface 385 which advances toward-respective side walls 342, 352, 362, and 372 of the door portions 340, 350, 360, and 370 in an outwardly sloping manner and an edge portion 386 which transitions back toward the longitudinal axis of each appendage 382 in a substantially perpendicular manner. The four notches 394 of the latching mechanism 380 each have a similar shape as the barbs 384 and are positioned to receive the barbs 384 when the door portions 340, 350, 360, and 370 are move into the closed position.

When the door portions 340, 350, 360, and 370 are rotated about their hinge portions 341, 351, 361, and 371 toward the closed position, the inclined camming surfaces 385 of the barbs 384 slidably engage the lower surface 312 of the main body-portion 310 while the appendages 382 flex slightly downwardly toward the interlocking fastening strips 308. When the door portions 340, 350, 360, and 370 reach the closed position, the barbs 384 of the appendages 382 are captured by the notches 386 formed in the lower surface 312 of the main body portion 310 while the edge portion 385 of each barb 384 engages an edge portion of each notch 386 to reliably retain the door portions 340, 350, 360, and 370 in the closed position. Once the barbs 384 have been captured by the notches 386 in this manner, the appendages 382 flex back into the position shown in FIG. 14.

While latching mechanism 380 provides a convenient means for retaining the four door portions 340, 350, 360, and 370 in the closed position, those skilled in the art will readily appreciate that other means for retaining the door portions 340, 350, 360, and 370 in the closed position may alternatively be employed without departing from the scope or spirit of the present invention. For example, the door portions 340, 350, 360, and 370 may be retained in the closed position by welding the door portions 340, 350, 360, and 370 to the main body portion 310 and/or the transverse body segments 320 and 330 or by providing a compression-type latch between the door portions 340, 350, 360, and 370 and either the main body portion 310 or the transverse body segments 320 and 330.

Once the slider member 300 has been slidably assembled onto the interlocking fastening strips 308, as shown, for example, in FIG. 10, the main body portion 310 is positioned above the interlocking fastening strips 308 in a substantially parallel manner with respect to the X-axis 104. In addition, the first and second transverse body segments 320 and 330 are substantially parallel to the Y-axis 305, and, the hinge portions 341, 351, 361, and 371 are substantially parallel to the Z-axis 306. Also, opposed door portions 340, 350, 360, and 370 are positioned on opposite sides of the X-axis 304 in a substantially parallel manner with respect to the interlocking fastening strips 308. In addition, the side members 322, 324, 332, and 334 of the first and second transverse body segments 320 and 330 are positioned on opposite sides of the Z-axis 106 in a substantially parallel manner with respect to the fastening strips 308.

As will be appreciated by those skilled in the art, the slider member 300 may also be provided with a separator finger which extends at least partially between the two interlocking fastening strips, as shown, for example, in FIGS. 30 and 31. In use, this finger provides for the separation of the fastening strips when the slider member is moved in the deocclusion direction, as disclosed in U.S. Pat. Nos. 5,007,142, 5,007,143, 5,010,627, 5,020,194, 5,067,208, 5,070,583, 5,088,971, 5,131,121, 5,161,286, 5,189,764, 5,282,932, 5,301,395, 5,426,830, 5,448,808, and 5,442,837.

Figure 15:
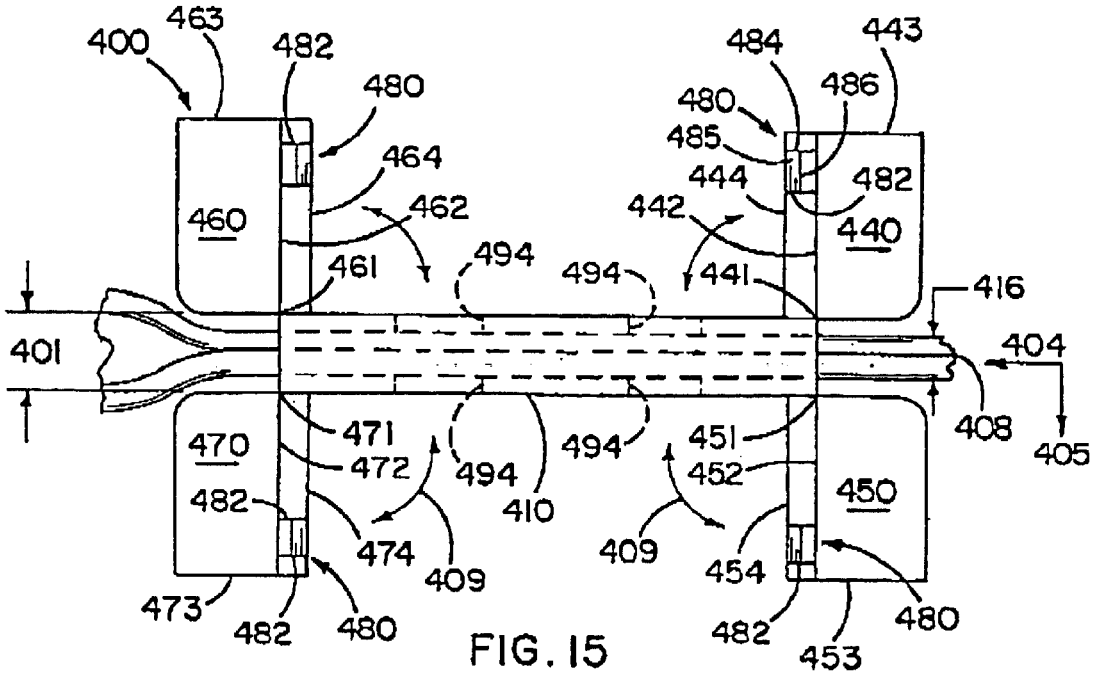
FIG. 15 is a partially fragmentary top plan view of a storage container utilizing a closure device comprised of interlocking fastening strips and a third embodiment of the slider member, and showing the door portions of the slider member in an open position upon the interlocking fastening strips.

The third embodiment of the inventive slider member 400 is shown in FIG. 15. The third embodiment of the slider member 400 includes a main body portion 410 which is adapted to be positioned upon and installed along the fastening strips 408. The slider member 400 also includes two pairs of opposed door portions 440, 450, 460, and 470 which are integrally hingedly attached to opposite outer corners of the main body portion 410 along respective hinge portions or living hinge structures 441, 451, 461, and 471. The four door portions 440, 450, 460, and 470 each have a first side surface 442, 452, 462, and 472, respectively, a second side surface 443, 453, 463, and 473, respectively, and a shoulder 444, 454, 464, and 474, respectively. The shoulders 444, 454, 464, and 474 are formed on a lower-end of the first side surface 442, 452, 462, and 472. On account of this construction, the main body portion 410 has a generally linear configuration when viewed from above, as shown in FIG. 15. Also, the slider member 400 has a generally H-shaped configuration when the four door portions 440, 450, 460, and 470 are open, as shown in FIG. 15.

As indicated by reference numeral 409 in FIG. 15, the hinge portions 441, 451, 461, and 471 permit movement of the four door portions 440, 450, 460, and 470 between a multiplicity of open positions including, for example, the open position shown in FIG. 15, and a closed position. In each of the open positions, the first side surfaces 442, 452, 462, and 472 of the door portions 440, 450, 460, and 470 are spaced-apart from the main body portion 410 (at locations away from the hinge portions 441, 451, 461, and 471), as shown, for example, in FIG. 15. In the closed position, conversely, the first side surfaces 442, 452, 462, and 472 of the door portions 440, 450, 460, and 470 engage the main body portion 410. Also, the shoulders 444, 454, 464, and 474 of the door portions 440, 450, 460, and 470 are substantially parallel to the main body portion 410.

During assembly, the main body portion 410 of the slider member 400 is initially positioned upon the interlocking fastening strips 408, as shown in FIG. 15, with the four door portions 440, 450, 460, and 470 in one of the open positions. When the door portions 440, 450, 460 and 470 are in the open position shown in FIG. 15, the slider member 400 has a first gap 401 which is greater than the width 416 of the fastening strips 408. Next, the four door portions 440, 450, 460, and 470 are moved into the closed position to slidably assemble the slider member 400 onto the interlocking fastening strips 408. In the closed position, the first side surface 442, 452, 462, and 472 of each door portion 440, 450, 460, and 470 abuts the main body portion 410 between its hinge portion 441, 451, 461, and 471 and its second side surface 443, 453, 463, and 473. In addition, opposed shoulders 444, 454, 464, and 474 of the four door portions 440, 450, 460, and 470 are separated by a second gap which is less than the width of the interlocking fastening strips 408 which prevents removal of the slider member 400 from the interlocking fastening strips 408.

In order to retain the door portions 440, 450, 460, and 470 in the closed position, the slider member 400 is provided with latching mechanisms 480. Each latching mechanism 480 includes an appendage 482 projecting outwardly from the first side surface 442, 452, 462, and 472 of each door portion 440, 450, 460, and 470 with a barb 484 at its distal end. Each latching mechanism 480 also includes cooperating notch 494 formed in a lower surface of the main body portion 410. The notches 494 have a similar shape as the barbs 484 and are positioned to receive the barbs 484 when the door portions 440, 450, 460, and 470 are move into the closed position. In the closed position, the barbs 484 of the appendages 482 are captured by the notches 494 formed in the lower surface of the main body portion 410. In addition, the edge portion 486 of each barb 484 engages an edge portion of each notch 494 to retain the door portions 440, 450, 460, and 470 in the closed position.

While latching mechanism 480 provides a convenient means for retaining the four door portions 440, 450, 460, and 470 in the closed position, those skilled in the art will readily appreciate that other means for retaining the door portions 440, 450, 460, and 470 in the closed position may alternatively be employed without departing from the scope or spirit of the present invention. For example, the door portions 440, 450, 460, and 470 may be retained in the closed position by welding the door portions 440, 450, 460, and 470 to the main body portion 410 or by providing a compression-type latch between the door portions 440, 450, 460, and 470 and the main body portion 410.

Once the slider member 400 has been slidably assembled onto the interlocking fastening strips 408, the main body portion 410 is positioned above the interlocking fastening strips 408 in a substantially parallel manner with respect to the X-axis 404 and the hinge portions 441, 451, 461, and 471 are substantially parallel to the Z-axis 406. In addition, opposed door portions 440, 450, 460, and 470 are positioned on opposite sides of the X-axis 404 in a substantially parallel manner with respect to the interlocking fastening strips 408.

As will be understood by those skilled in the art, the slider member 400 may also be provided with a separator finger which extends at least partially between the two interlocking fastening strips 408, as shown, for example, in FIGS. 30 and 31. In use, this finger provides for the separation of the fastening strips when the slider member 400 is moved in the deocclusion direction, as disclosed in U.S. Pat. Nos. 5,007,142, 5,007,143, 5,010,627, 5,020,194, 5,067,208, 5,070,583, 5,088,971, 5,131,121, 5,161,286, 5,189,764, 5,282,932, 5,301,395, 5,426,830, 5,448,808, and 5,442,837.

Figure 16:
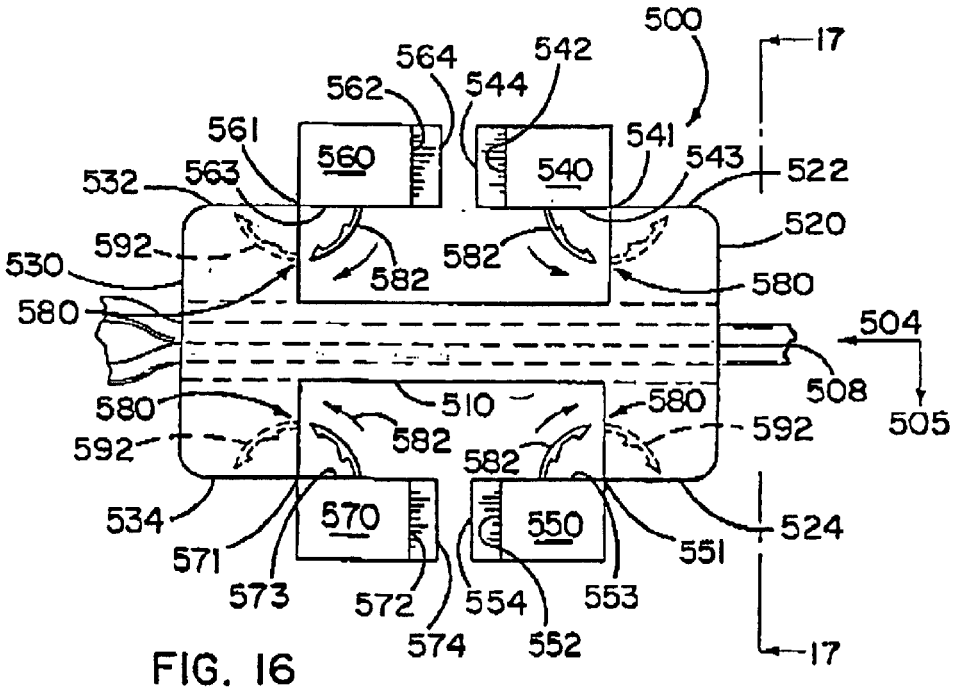
FIG. 16 is a partially fragmentary top plan view of a storage container utilizing a closure device comprised of interlocking fastening strips and a fourth embodiment of the slider member, and showing the door portions of the slider member in an open position upon the interlocking fastening strips.
Figure 17:
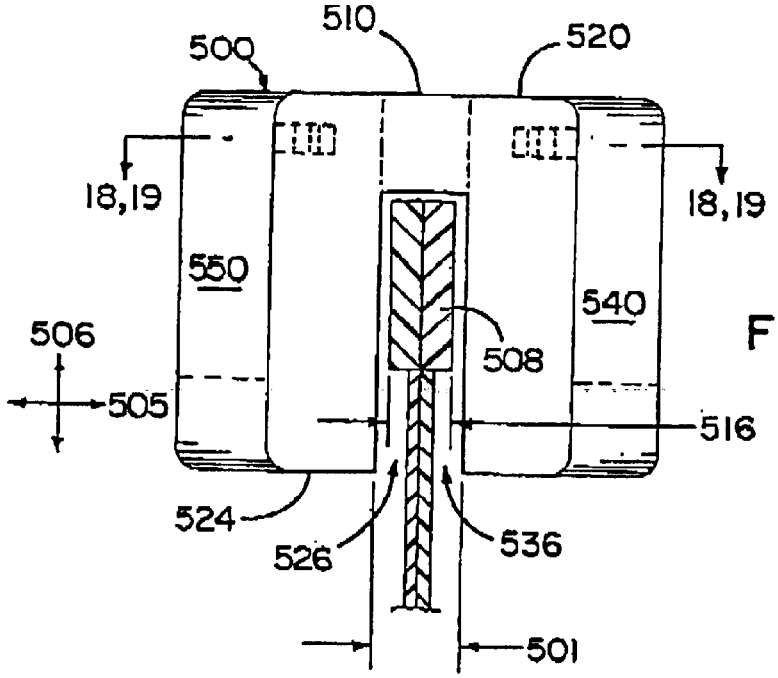
FIG. 17 is a rear end view of the slider member as seen in the direction of line 17—17 of FIG. 16.
Figure 18:
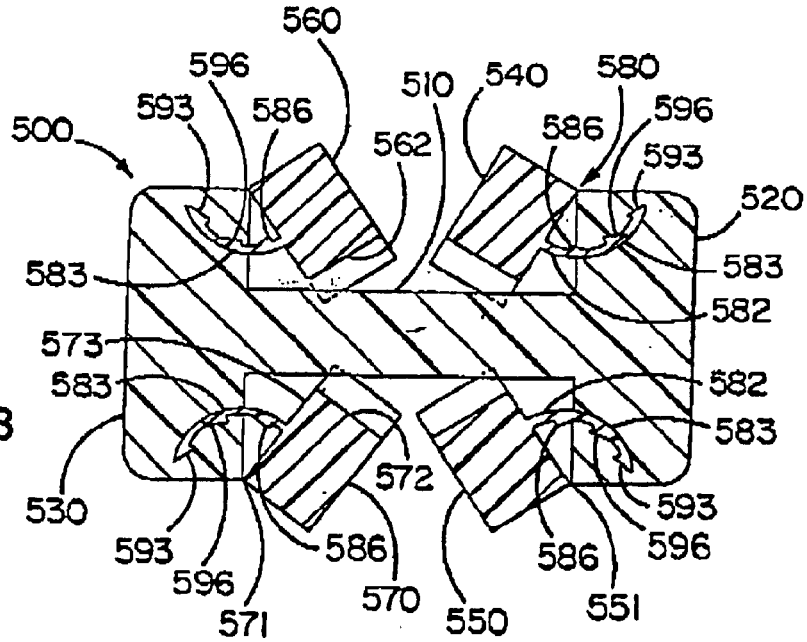
FIG. 18 is a cross-sectional view of the slider member taken along line 18—18 in FIG. 17, but showing the door portions of the slider member in a partially open position.

As shown in FIGS. 16–20, the fourth embodiment of the inventive slider member 500 includes a main body portion 510 which is adapted to be positioned upon and installed along the interlocking fastening strips 508. As in the second embodiment of the slider member 300, the main body portion 510 of the slider member 500 includes a pair of transverse body segments or saddles 520 and 530 formed on opposite ends thereof and arranged substantially perpendicular thereto. As shown in FIG. 17, the first transverse body segment 520 includes a pair of downwardly extending side members 522 and 524 with a slot or opening 526 therebetween. Similarly, the second transverse body segment 530 also includes a pair of downwardly extending side members 532 and 534 with a slot or opening 536 therebetween. On account of this construction, the main body portion 510 and the transverse body segments 520 and 530 of slider member 500 have a generally H-shaped configuration when viewed from above, as shown in FIGS. 16 and 18. In addition, each transverse body segment 520 and 530 has an inverted U-shaped configuration when viewed from the front and rear, as shown, for example, in FIG. 17.

The slider member 500 is also provided with two pairs of door portions 540, 550, 560, and 570 which are integrally hingedly attached to opposed outer corners of the first and second transverse body segments 520 and 530 along respective hinge portions or living hinge structures 541, 551, 561, and 571. As best shown in FIGS. 16 and 18, each door portion 540, 550, 560, and 570 has a first side surface 542, 552, 562, and 572, respectively, a second side surface 543, 553, 563, and 573, respectively, and a shoulder 544, 554, 564, and 574, respectively. Each shoulder 544, 554, 564, and 574 is formed at a lower end of the first side surfaces 542, 552, 562, and 572.

Figure 19:
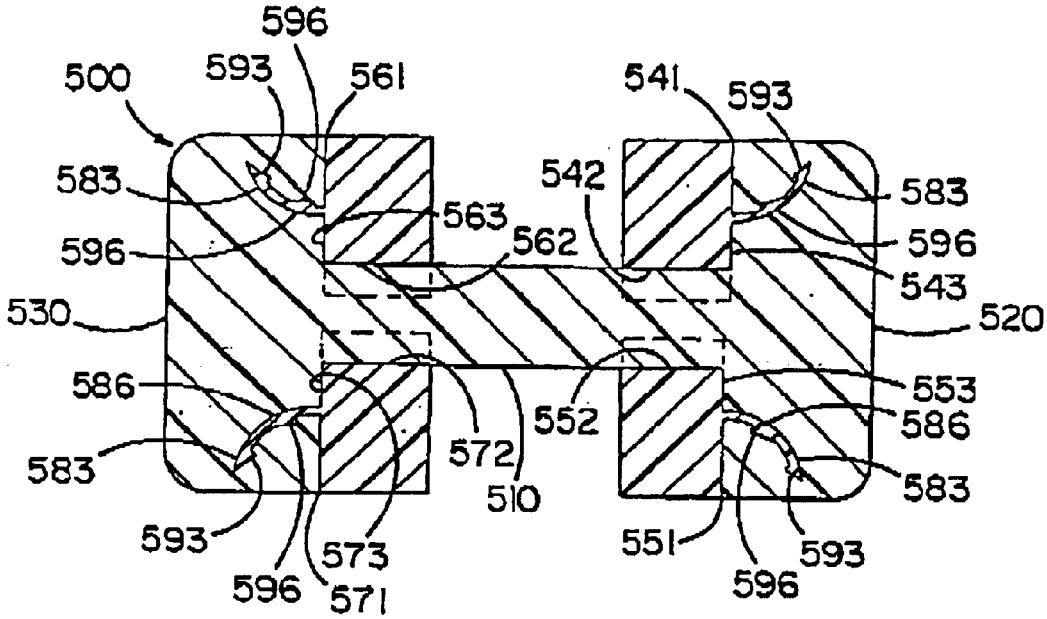
FIG. 19 is a cross-sectional view of the slider member taken along line 19—19 in FIG. 17, but showing the door portions of the slider member in a closed position.

In usage, the hinge portions 541, 551, 561, and 571 permit the four door portions 540, 550, 560, and 570 to be moved between a closed position, as shown in FIG. 19, and a multiplicity of open positions including, for example, a first open position, as shown in FIGS. 16 and 17, or a second open position, as shown in FIG. 18. In each of the open positions, the first side surfaces 542, 552, 562, and 572 are spaced-apart from the main body portion 510, as shown, for example in FIGS. 16 and 18. Also, the second side surfaces 453, 553, 563, and 573 are spaced-apart from the transverse body segments 520 and 530 (at locations away from the hinge portions 541, 551, 561, and 571). In the closed position, the first side surfaces 542, 552, 562, and 572 are adjacent to the main body portion 510, as shown in FIG. 19, and the second side surfaces 543, 553, 563, and 573 are adjacent to one of the transverse body segments 520 and 530. In addition, the shoulders 544, 554, 564, and 574 are arranged substantially parallel to the main body portion 510.

During assembly, the main body portion 510 of the slider member 500 is initially positioned upon the interlocking fastening strips 508, with the side members 522, 524, 532, and 534 of the transverse body segments 520 and 530 straddling the fastening strips 508 and the four door portions 540, 550, 560, and 570 in an open position, as shown in FIGS. 16, 17 and 18. Because the hinge portions 541, 551, 561, and 571 are located at the outer corners of the transverse body segments 520 and 530, the side walls 542, 552, 562, and 572 may not require notches to facilitate receipt of the slider member 500 by the interlocking fastening strips 508 when the door portions 540, 550, 560, and 570 are open. Also, the openings 526 and 536 between the opposed side members 522, 524, 532, and 534 of the transverse body segments 520 and 530 are sized to receive the interlocking fastening strips 508, as shown in FIG. 17. Thus, when the door portions 540, 550, 560 and 570 are in an open position, the slider member 500 has a first gap 501 which is greater than the width 516 of the fastening strips as shown in FIG. 17. As such, the main body portion 510 of the slider member 500 may be installed upon the interlocking fastening strips 508 when the door portions 540, 550, 560, and 570 are in an open position, without interfering with the shoulders 544, 554, 564, and 574 of the door portions 540, 550, 560, and 570.

Once the slider member 500 has been installed upon the interlocking fastening strips 508 in this manner, the door-portions 540, 550, 560, and 570 are moved toward the closed position to assemble the slider member 500 onto the interlocking fastening strips 508. In particular, each door portion 540, 550, 560, and 570 is initially moved from the first open position, as shown in FIGS. 16 and 17, into the second open position, as shown in FIG. 18. Thereafter, each door portion 540, 550, 560, and 570 is moved from the second open position, as shown in FIG. 18, into the closed position, as shown in FIG. 19. When the door portions 540, 550, 560 and 570 are in the closed position, the opposed shoulders 544, 554, 564 and 574 of the door portions are separated by a second gap which is less than the width 516 of the fastening strips 508.

Figure 20:
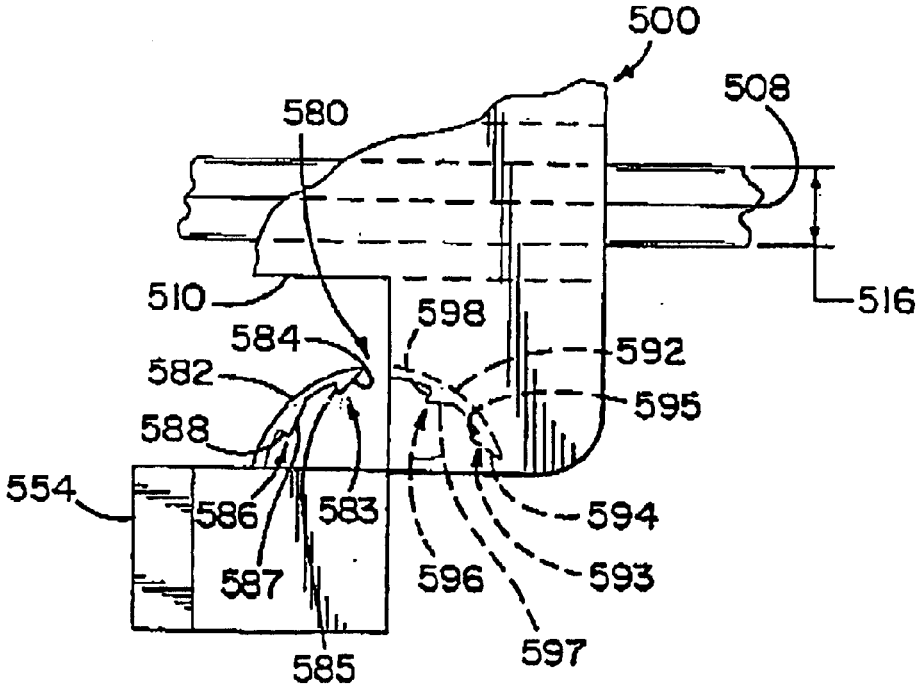
FIG. 20 is an enlarged, partially fragmentary, top plan view of the slider member depicted in FIG. 16.

In order to selectively retain the door portions 540, 550, 560, and 570 in a plurality of distinct assembly positions, including the second open position and the closed position, the slider member 500 is provided with latching mechanisms 580. In this embodiment, each latching mechanism 580 comprises a generally arcuate appendage 582 which projects outwardly from the second side surface 543, 553, 563, and 573 of each door portion 540, 550, 560, and 570, and a pair of cooperating and generally arcuate slots 592 formed in each transverse body segment 520 and 530. As shown in FIG. 20, each appendage 582 has two barbs formed along its length, including a first barb 583 at its distal end and a second barb 586 inboard thereof. Similarly, each slot 592 has two cooperating notches formed along its length, including a first notch 593 at its innermost end and a second notch 596 inboard thereof. In addition, each barb 583 and 586 and each notch 593 and 596 has a generally right-triangular configuration. As shown in FIG. 20, the first and second barbs 583 and 586 each have an inclined camming surface 584 and 587, respectively, and an edge portion 585 and 588, respectively. Similarly, the first and second notches 593 each have an inclined camming surface 594 and 597, respectively, and an edge portion 595 and 598, respectively.

When the door portions 540, 550, 560, and 570 are rotated about their hinge portions 541, 551, 561, and 571 toward the closed position, the appendages 582 are received by respective slots 592. In addition, the two barbs 583 and 586 of the appendages 582 interact with the two notches 593 and 596 of the slots 592 to provide two distinct assembly positions, including one at the second open position, as shown in FIG. 18, and one at the closed position, as shown in FIG. 19. For example, when the appendages 582 are pushed into the slots 592 during assembly, the inclined camming surface 584 of the first barb 583 of each appendage 582 causes the slots 592 to expand slightly to facilitate receipt and insertion of the appendages 582. Upon reaching the second open position as shown in FIG. 18, the first barb 583 of each appendage 582 is captured by the second notch 596 of each slot 592. In addition, the edge portion 585 of the first barb 583 engages the edge portion 598 of the second notch 596 to retain the door portions 540, 550, 560, and 570 in an open position. When the appendages 582 are pushed further into the slots 592, the inclined camming surfaces 583 and 587 of the first and second barbs 583 and 586 cause the slots 592 to expand slightly again to facilitate further receipt and insertion of the appendages 582. When the door portions 540, 550, 560, and 570 reach the closed position as shown in FIG. 19, the first and second barbs 583 and 587 of each appendage 582 are captured by the first and second notches 593 and 597 of each slot 592, respectively. In addition, the edge portions 585 and 588 of the first and second barbs 583 and 587 engage the edge portions 595 and 598 of the first and second notches 593, respectively, to reliably retain the door portions 540, 550, 560, and 570 in the closed position.

While latching mechanism 580 provides a convenient means for retaining the four door portions 540, 550, 560, and 570 in a plurality of assembly positions, including one at the closed position, those skilled in the art will readily appreciate that other means for retaining the door portions 540, 550, 560, and 570 in the closed position may alternatively be employed without departing from the scope or spirit of the present invention. For example, the door portions 540, 550, 560, and 570 may be retained in the closed position by welding the door portions 540, 550, 560, and 570 to either the main body portion 510 or the transverse body segments 520 and 530 or by providing a compression-type latch between the door portions 540, 550, 560, and 570 and the main body portion 310 and/or the transverse body segments 520 and 530.

Once the slider member 500 has been assembled onto the interlocking fastening strips 508, the main body portion 510 is oriented above the interlocking fastening strips 508 in a substantially parallel manner with respect to the X-axis 104. In addition, the first and second transverse body segments 520 and 530 are substantially parallel to the Y-axis 505 the hinge portions 541, 551, 561, and 571 are substantially parallel to the Z-axis 506. Also, opposed side walls 542, 552, 562, and 572 of the four door portions 540, 550, 560, and 570 are positioned on opposite sides of the X-axis 504 in a substantially parallel manner with respect to the interlocking fastening strips 508. Moreover, opposed side members 522, 524, 532, and 534 of the transverse body segments 520 and 530 are positioned on opposite sides of the Z-axis 506 in a substantially parallel manner with respect to the interlocking fastening strips 508.

As will be appreciated by those skilled in the art, the slider member 500 may also be provided with a separator finger which extends at least partially between the two interlocking fastening strips, as shown, for example, in FIGS. 30 and 31. In use, this finger provides for the separation of the fastening strips when the slider member is moved in the deocclusion direction as disclosed in U.S. Pat. Nos. 5,007,142, 5,007,143, 5,010,627, 5,020,194, 5,067,208, 5,070,583, 5,088,971, 5,131,121, 5,161,286, 5,189,764, 5,282,932, 5,301,395, 5,426,830, 5,448,808, and 5,442,837.

Figure 21:
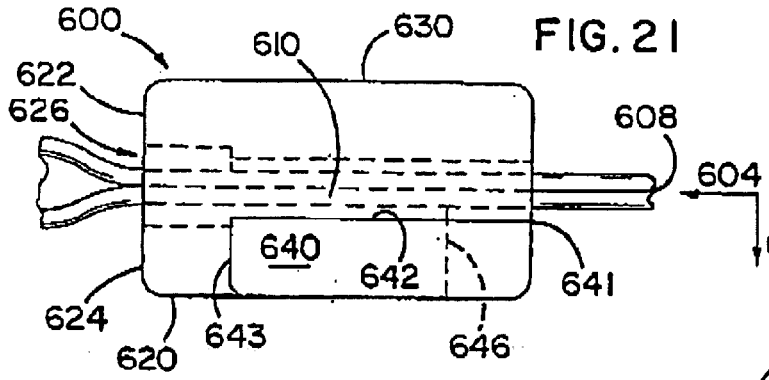
FIG. 21 is a partially fragmentary top plan view of a storage container utilizing a closure device comprised of interlocking fastening strips and a fifth embodiment of the slider member.
Figure 23:
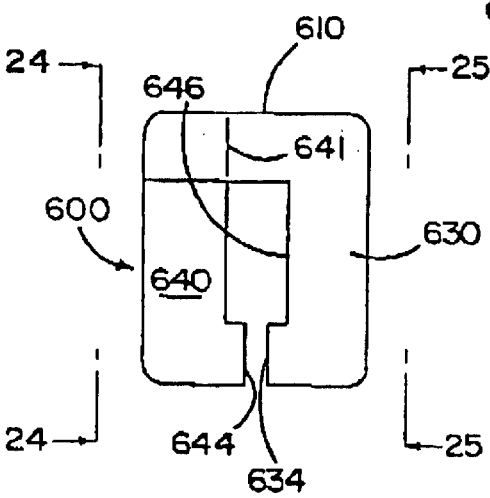
FIG. 23 is a rear end view of the slider member depicted in FIG. 21, but showing the door portion of the slider member in a closed position.
Figure 22:
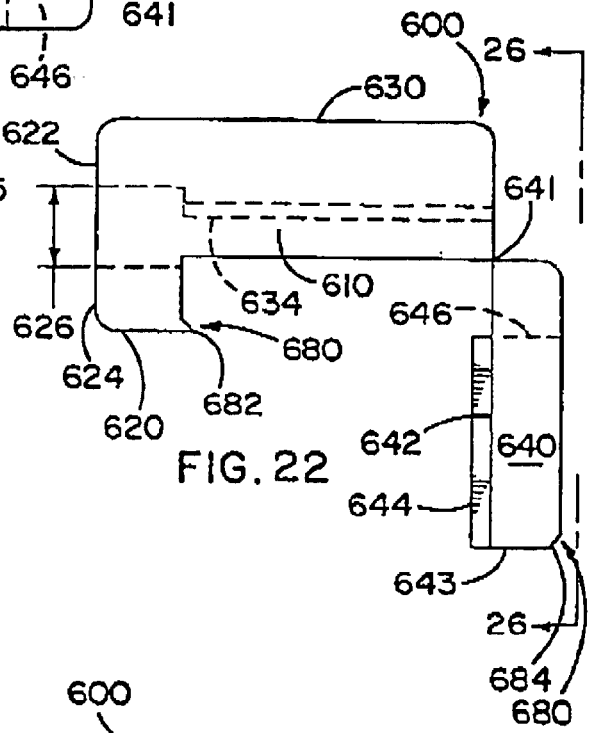
FIG. 22 is a top plan view of the slider member depicted in FIG. 21, but showing the interlocking fastening strips removed for clarity and the door portion of the slider member in an open position.
Figure 24:
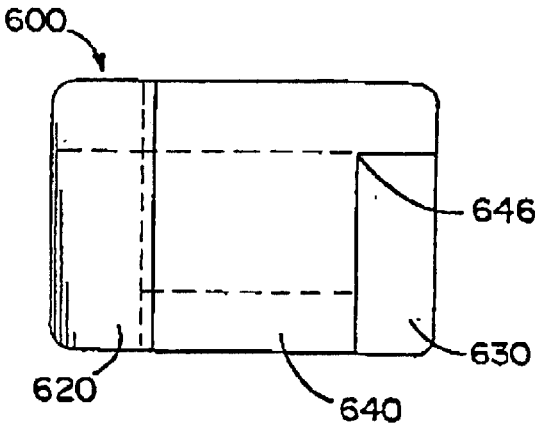
FIG. 24 is a side elevational view of the slider member as seen in the direction of line 24—24 of FIG. 23.
Figure 25:
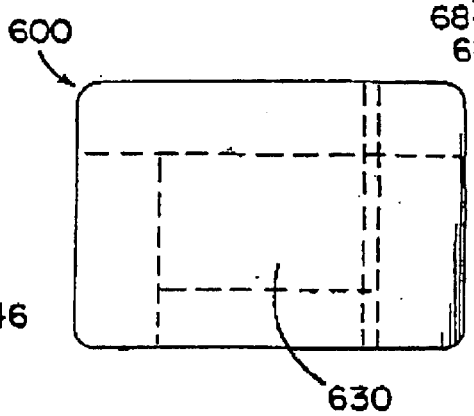
FIG. 25 is a side elevational view of the slider member as seen in the direction of line 25—25 of FIG. 23.
Figure 26:
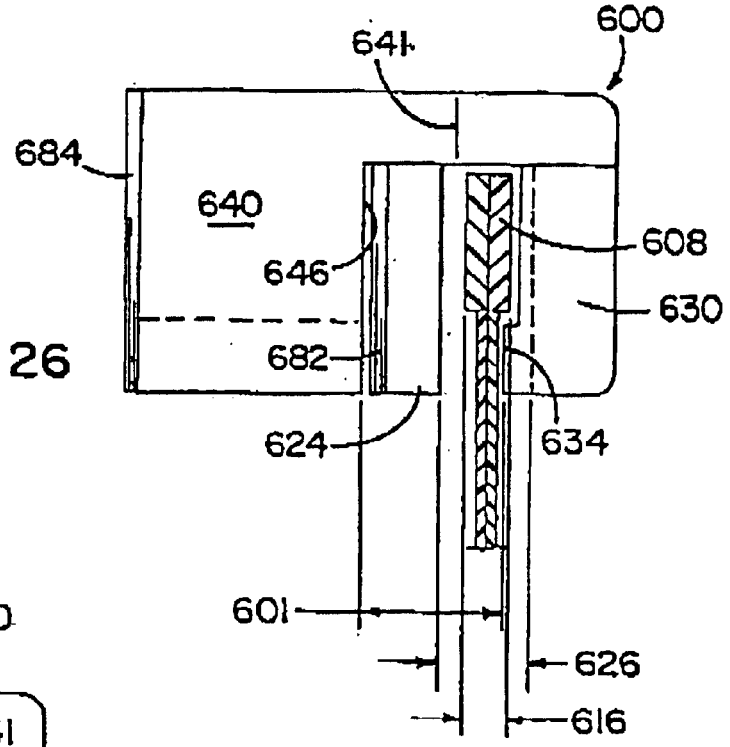
FIG. 26 is a rear end view of the slider member as seen in the direction of line 26—26 of FIG. 22, but showing the slider member installed upon interlocking fastening strips.
Figure 27:
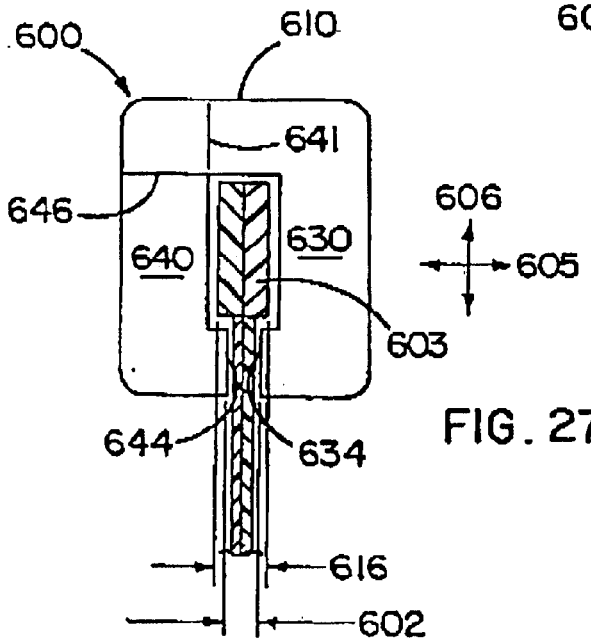
FIG. 27 is a rear end view of the slider member similar to FIG. 26, but showing the door portion of the slider member in the closed position.

The fifth embodiment of the inventive slider member 600 is shown in FIGS. 21–27. This fifth embodiment of the slider member 600 includes a main body portion 610 which is adapted to be positioned upon and installed along the interlocking fastening strips 608. As shown in FIG. 22, the main body portion 610 includes an integral transverse body segment or saddle 620 formed on one end thereof and an integral and downwardly extending side leg segment 630 formed on one side thereof. The transverse body segment 620 of slider member 600 is arranged substantially perpendicular to the main body portion 610 and includes a pair of downwardly extending side members 622 and 624 with a slot or opening 626 therebetween. In addition, the side leg segment 630 is arranged substantially parallel to the main body portion 610 and is formed integrally with side member 624 of the transverse body segment 620. The side leg segment 630 includes a shoulder 634 which is formed on a lower end of its inside face, as shown in FIGS. 23 and 27.

The slider member 600 is also provided with a single door portion 640 which is integrally hingedly attached to the main body portion 610 along a hinge portion or living hinge structure 641. As shown in FIGS. 22, 23 and 27, the door portion 640 includes a first side surface 642, a second side surface 643, and a shoulder 644 formed at a lower end of the first side surface 642. In usage, the hinge portion 641 permits the door portion 640 to be moved between a closed position, as shown in FIGS. 21, 23, 24 and 27, and a multiplicity of open positions including, for example, an open position shown in FIGS. 22 and 26. In each of the open positions, the first side surface 642 of the door portion 640 is spaced-apart from the main body portion 610 (at locations away from the hinge portion 641), as shown, for example in FIG. 22, and the second side surface 643 is spaced-apart from the transverse body segment 620. In the closed position, the first side surface 642 of the door portion 640 is adjacent to the main body portion 610 as shown in FIG. 21, and the second side surface 643 is adjacent to the transverse body segment 620 as shown in FIG. 21. In addition, the shoulder 644 of the door portion 640 is arranged substantially parallel to the shoulder 634 of side leg segment 630 as shown in FIGS. 23 and 27.

During assembly, the main body portion 610 of the slider member 600 is positioned upon the interlocking fastening strips 608, with the opposed side members 622 and 624 of the transverse body segment 620 straddling the interlocking fastening strips 608 and the door portion 640 in one of the open positions. In order to facilitate receipt of the slider member 600 by the interlocking fastening strips 608 when the door portion 640 is open, a notch 646 is provided at the rear end of the door portion 640. In particular, this notch 646 is located beneath the hinge portion 641 on a lower section of the door portion 640. Thus, when the door portion 640 is in one of the open positions as shown in FIG. 26, this notch 646 provides a first gap 601 between the door portion 640 and the side leg segment 630 which is large enough to receive the interlocking fastening strips 608. The opening 626 between the opposed side members 622 and 624 of the transverse body segment 620 is also large enough to receive the interlocking fastening strips 608. As such, the main body portion 610 of the slider member 600 may be installed upon the interlocking fastening strips 608 when the door portion 640 is in one of the open positions, without interfering with the shoulder 634 of the side leg segment 630.

Once the slider member 600 has been installed upon the interlocking fastening strips 608 in this manner, the door portion 640 is then moved into the closed position to assemble the slider member 600 onto the interlocking fastening strips 608. In the closed position, the first side surface 642 of the door portion 640 abuts the main body portion 610 between its hinge portion 641 and its second side surface 643 as shown in FIG. 21. In addition, the second side surface 643 abuts the transverse body segment 620. Also, the shoulder 644 of the door portion 640 is separated from the shoulder 634 of the side leg segment 630 by a second gap 602 (see FIG. 27) which is less than the width 616 of the interlocking fastening strips 608. As a consequence, the slider member 600 may not be removed from the interlocking fastening strips 608 when the door portion 640 is in the closed position.

In order to retain the door portion 640 in the closed position, the slider member 600 is also provided with a convenient latching mechanism 680. As shown in FIG. 22, the latching mechanism 680 of the present embodiment comprises a protuberance 682 formed along an edge of the transverse body segment 620 and a cooperating chamfer 684 formed along an edge of the door portion 640. When the door portion 640 of the slider member 600 is moved into the closed position, the protuberance 682 interlockingly engages the chamfer 684 as shown in FIG. 21, to retain the door portion 640 in the closed position.

While latching mechanism 680 provides a convenient means for retaining the door portion 640 in the closed position, those skilled in the art will readily appreciate that other means for retaining the door portion 640 in the closed position may alternatively be employed without departing from the scope or spirit of the present invention. For example, the door portion 640 may be retained in the closed position by welding the door portion 640 to either the main body portion 610 or to the transverse body segment 620 or by providing a compression type latch between the door portion 640 and either the main body portion 610 or the transverse body segment 620.

Once the slider member 600 has been assembled onto the interlocking fastening strips 608 as shown in FIG. 21, the main body portion 610 is positioned above the interlocking fastening strips 608 in a substantially parallel manner with respect to the X-axis 604 and the transverse body segment 620 is substantially parallel to the Y-axis 605. Also, the hinge portion 641 is substantially parallel to the Z-axis 606. In addition, the side wall 642 of the door portion 640 and the side leg segment 630 of the main body portion 610 are positioned on an opposite sides of the interlocking fastening strips 608 in a substantially parallel manner with respect to the X-axis 604. Also, the opposed side members 622 and 624 of the transverse body segment 620 are positioned on opposite sides of the interlocking fastening strips 608 in a substantially parallel manner with respect to the Z-axis 606.

As will be understood by those skilled in the art, the slider member 600 may also be provided with a separator finger which extends at least partially between the two interlocking fastening strips, as shown, for example, in FIGS. 30 and 31. In use, this finger provides for the separation of the interlocking fastening strips when the slider member 600 is moved in the deocclusion direction, as disclosed in U.S. Pat. Nos. 5,007,142, 5,007,143, 5,010,627, 5,020,194, 5,067,208, 5,070,583, 5,088,971, 5,131,121, 5,161,286, 5,189,764, 5,282,932, 5,301,395, 5,426,830, 5,448,808, and 5,442,837.

While several different embodiments of the inventive one-piece slider member have been specifically described and illustrated herein, it will be appreciated by those skilled in the art that these particular embodiments have been provided for illustrative purposes only and do not represent an exhaustive register of each and every slider member covered by the present invention. Indeed, other types, kinds, versions, and forms of the slider member may alternatively be employed without departing from the scope or spirit of the present invention.

Figure 28:
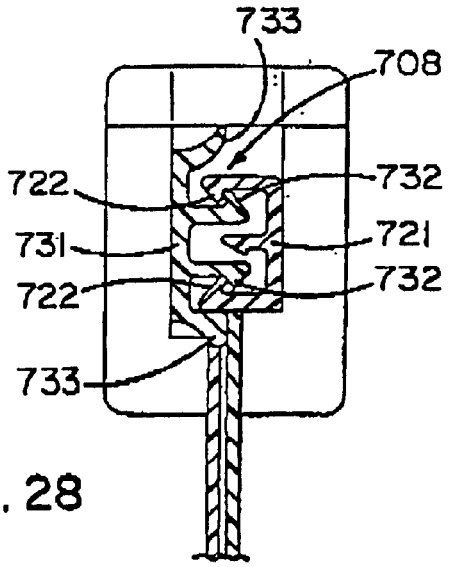
FIG. 28 is a cross-sectional view taken along line 28—28 in FIG. 2, showing a first embodiment of the interlocking fastening strips.

As mentioned briefly above, the interlocking fastening strips of the closure device may also be of virtually any type, kind, version, or form. By way of example, the interlocking fastening strips 708 may comprise U-channel type fastening strips, as shown herein at FIG. 28. U-channel fastening strips include a female web element 721 which interlockingly receives a male web element 731. As shown in FIG. 28, the male web element 731 includes a pair of inner hook portions 732 and a pair of outer wings 733 while the female web element 721 includes a pair of hook portions 722 which are adapted to interlockingly engage the hook portions 732 of the male web element 731.

Figure 29:
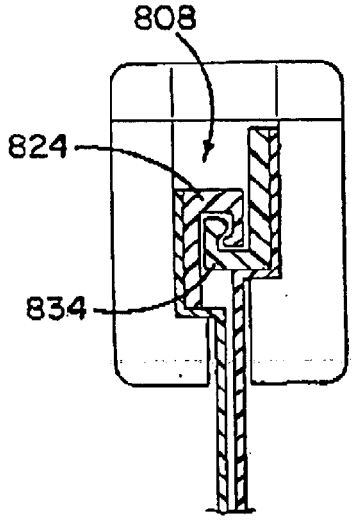
FIG. 29 is a cross-sectional view taken along line 29—29 in FIG. 2, but showing a second embodiment of the interlocking fastening strips.

The interlocking fastening strips of the closure device may also comprise shear action or Z-axis fastening strips, as shown-herein at FIG. 29. Shear action fastening strips 808 include a first web 824 and a complementary second web 834 which engages the first web 824 when the slider member is moved in the occlusion direction.

In addition, the interlocking fastening strips may alternatively comprise arrowhead-type fastening strips, as shown herein at FIG. 30. As described more fully in U.S. Pat. No. 3,198,228 (which reissued as Re. 28,969), U.S. Pat. Nos. 4,736,496, and 5,363,540, arrowhead-type fastening strips 908 include a first web 926 with a C-shaped engagement portion 927 and a second web 936 with an arrowhead-shaped engagement portion 937. In use, the first web 926 and the second web 936 are occluded and deoccluded by moving the slider member in the appropriate direction. This occlusion and deocclusion action is facilitated by a separator finger 990 which projects downwardly between the first web 926 and the second web 936.

The interlocking fastening strips may also comprise rolling action fastening strips, as shown for example, at FIG. 31. As described in greater detail in U.S. Pat. No. 5,007,143, rolling action fastening strips 1008 include elements 1038 and 1028.

Figure 32:
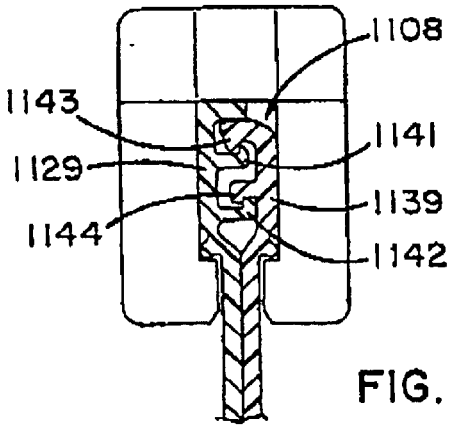
FIG. 32 is a cross-sectional view taken along line 32—32 in FIG. 2, but showing a fifth embodiment of the interlocking fastening strips.

The interlocking fastening strips may alternatively comprise profile fastening strips, as shown herein at FIG. 32. As described more fully in U.S. Pat. No. 5,664,299, profile fastening strips 1108 include a first profile 1129 having uppermost and bottommost closure elements 1141 and 1142, respectively, and a second profile 1139 having corresponding uppermost and bottommost closure elements 1143 and 1144, respectively.

It will be readily appreciated by those skilled in the art that each embodiment of the inventive slider member may be utilized with any type of the interlocking fastening strips including, but not limited to, those shown in FIGS. 28–32, without departing from the scope or spirit of the present invention. In addition, each embodiment the slider member may be formed from a suitable plastic material, such as, nylon, polypropylene, polystyrene, acetal, toughened acetal, polyketone, polybutylene, terraphthalate, high density polyethylene, polycarbonate, ABS (acrylonitrile-butadiene-styrene), or the like. Also, each embodiment of the slider member may be transparent, translucent, colored or opaque.

The interlocking fastening strips may be manufactured by extrusion through a die. In addition, the fastening strips may be manufactured to have approximately uniform cross-sections. This not only simplifies the manufacturing of the closure device, but also contributes to the physical flexibility of the closure device, which may be a desirable property.

Generally, the interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to form the fastening strips. In most instances, the fastening strips are preferably made from low density polyethylene. The selection of the appropriate thermoplastic material, however, is related to the particular design of the fastening strips, the Young's Modulus of the thermoplastic material, and the desired elasticity and flexibility of the strips.

When the interlocking fastening strips of the present invention are used in a sealable bag, the fastening strips and the films that form the side walls of the bag may be conveniently manufactured from heat sealable material. In this way, the bag may be economically formed by using an aforementioned thermoplastic material and by heat sealing the fastening strips to the bag. In most instances, the bag is made from a mixture of high pressure, low density polyethylene and linear, low density polyethylene.

The interlocking fastening strips may be manufactured by extrusion or other known methods. For example, the closure device may be manufactured as individual fastening strips for later attachment to the side walls of the bag or may be manufactured integrally therewith. In addition, the fastening strips may be manufactured with or without flange portions on one or both of the fastening strips depending upon the intended use of the closure device or expected additional manufacturing operations.

Generally, the closure device can be manufactured in a variety of forms to suit an intended use. In practicing the present invention, the closure device may be integrally formed on the opposing side walls of the container or bag, or connected to the container by way of any known method. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

In summary, the present invention provides a single-piece slider member for use with interlocking fastening strips disposed along opposing side walls of a storage container, such as a conventional plastic bag. The slider member comprises a main body portion which is adapted to be installed upon the interlocking fastening strips. The slider also includes a door portion which is hingedly attached to the main body portion along a hinge portion for movement between open and closed positions. When the main body portion of the slider member is installed upon the interlocking fastening strips, the hinge portion is substantially perpendicular thereto. The slider member is also provided with a latching mechanism which conveniently retains the door portion in the closed position. During assembly, the main, body portion of the slider member is installed upon the interlocking fastening strips and then the door portion is moved into the closed position to attach the slider member onto the interlocking fastening strips.

While the present invention has been described and disclosed in connection with certain illustrated embodiments, it will be understood, of course, that there is no intention to limit the invention to the disclosed structural forms. On the contrary, the intention is to cover to cover all modifications, alternative constructions, and equivalents that fall within the scope and spirit of the present invention as defined by the following claims. In addition, all references and co-pending applications cited herein are hereby incorporated by reference in their entireties.

What is claimed is:

1. A closure device comprising:

interlocking fastening strips; and a slider member slidably disposed on the interlocking fastening strips, the slider member facilitating the occlusion of the interlocking fastening strips when moved towards a first end thereof, the slider member including swain body portion and a door portion which is hingedly attached to the main body portion along a hinge portion for movement between open and closed positions, the hinge portion being substantially perpendicular to the interlocking fastening strips when the main body portion is installed upon the fastening strips, the door portion of the slider member includes a first side surface, a second side surface, and a shoulder disposed at a lower end of the first side surface, the first side surface is spaced-apart from the main body portion when said door portion is in the open position and is adjacent to the main body portion when said door portion is in the closed position.

2. The invention as in claim 1 wherein the slider member has a first gap when the door portion is in the open position, said first gap is large enough to receive the fastening strips.

3. The invention as in claim 2 wherein the fastening strips have a width and the slider member has a second gap when the door portion is in the closed position, said second gap is less than the width of the fastening strips.

4. The invention as in claim 1 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

5. The invention as in claim 1 wherein the main body portion includes a transverse body segment arranged substantially perpendicular to the main body portion and having a pair of downwardly extending side members with an opening therebetween, the opening being sized to receive the interlocking fastening strips.

6. The invention as in claim 5, wherein the first side surface is adjacent to the main body portion and the second side surface is adjacent to said transverse body segment when said door portion is in the closed position.

7. The invention as in claim 5, wherein said slider member includes a second transverse body segment.

8. The invention as in claim 7, wherein said first transverse body segment being arranged at a first end of the main body portion and said second transverse body segment is at a second end of the main body portion.

9. The invention as in claim 7, wherein said slider member includes a second door portion, a third door portion and a fourth door portion, each door portion including a first side surface, a second side surface, and a shoulder at a lower end of the first side surface.

10. The invention as in claim 9 wherein the first side surface is adjacent to the main body portion and the second side surface is adjacent to one of the two transverse body segments when the door portions are in the closed position.

11. The invention as in claim 1 wherein said slider member includes a second door portion, said second door portion including a first side surface, a second side surface, and a shoulder at a lower end of the first side surface.

12. The invention as in claim 11 wherein each of said door portions includes a notch which is proximal to its hinge portion.

13. The invention as in claim 12 wherein the notches provide a first gap between the door portions when open position, said first gap is large enough to receive the interlocking fastening strips.

14. The invention as in claim 11 wherein the shoulders of the door portions are separated by a second gap when the door portions are in the closed position, the second being less than the width of the interlocking fastening strips.

15. The invention as in claim 1 wherein said slider member includes a second door portion, a third door portion and a fourth door portion, each of said door portions including a side surface and a shoulder at a lower end of the side surface.

16. The invention as in claim 1, wherein the main body portion includes a downwardly extending side leg segment disposed along a side thereof and a transverse body segment disposed at an end thereof, the side leg segment having a shoulder at a lower end thereof and the transverse body segment having a pair of spaced-apart side members with an opening therebetween.

17. The invention as in claim 16 wherein the door portion includes a notch which is proximal to its hinge portion.

18. The invention as in claim 17 wherein the notch of the door portion and the side leg segment of the main body portion are separated by a first gap when the door portion is in the open position, the first gap being large enough to receive the interlocking fastening strips.

19. The invention as in claim 17 wherein the shoulder of the side surface and the shoulder of the leg segment ate separated by a second gap when the door portion is in the closed position, the second gap being less than the width of the interlocking fastening strips.

20. The invention as in claim 1 wherein the slider member further includes a latching mechanism for retaining said door portion in the closed position.

21. The invention as in claim 20 wherein the latching mechanism comprises an appendage projecting outwardly from said door portion and a cooperating notch formed in the main body portion, the appendage having a barb at its distal end, the notch of the latching mechanism capturing the barb of the latching mechanism when said door portion is moved into the closed position.

22. The invention as in claim 1 wherein the slider member further includes a latching mechanism for retaining said door portion in the closed position and the main body portion includes a transverse body segment.

23. The invention as in claim 22 wherein the latching mechanism comprises a protuberance formed along said transverse body segment of the main body portion and a cooperating chamfer formed along an edge of said door portion the protuberance of the latching mechanism interlockingly engaging the chamfer of the latching mechanism when said door portion is moved into the closed position.

24. The invention as in claim 22 wherein the latching mechanism comprises a generally accurate appendage projecting outwardly from said door portion and a generally arcuate cooperating slat farmed in said transverse body segment of the main body portion, the slot of the latching mechanism having a first notch formed along its length and the appendage of the latching mechanism having a first barb formed along its length, the slot of the latching mechanism receiving the appendage of the latching mechanism when said door portion is moved toward the closed position while said first barb of the appendage interacts with said first notch of the slot to provide a first assembly position for said door portion.

25. The invention as in claim 24 wherein said slot includes a second notch and said first barb interacts with said second notch to provides second assembly position for said door portion.

26. The invention as in claim 25 wherein said first assembly position is an open position.

27. The invention as in claim 25 wherein said appendage having a second barb and said second barb interacts with said second notch in said second assembly position.

28. The invention as in claim 24 wherein said first assembly position is a closed position.

29. The invention as in claim 1 wherein the interlocking fastening strips comprise U-channel type fastening strips.

30. The invention as in claim 1 wherein the interlocking fastening strips comprise shear action fastening strips.

31. The invention as in claim 1 wherein the interlocking fastening strips comprise arrowhead-type fastening strips.

32. The invention as in claim 1 wherein the interlocking fastening strips comprise rolling action fastening strips.

33. The invention as in claim 1 wherein the interlocking fastening strips comprise profile fastening strips.

34. A slider member adapted to facilitate the occlusion of interlocking fastening strips, the slider member comprising:

a main body portion which is adapted to be installed upon the interlocking fastening strips; and a door portion which is hingedly attached to the main body portion along a hinge portion for movement between open and closed positions, the hinge portion being substantially perpendicular to the interlocking fastening strips when the main body portion is installed upon the fastening strips, the door portion of the slider member includes a first side surface, a second side surface, and a shoulder disposed at a lower end of the first side surface, the first side surface is spaced-apart from the main body portion when said door portion is in the open position and is adjacent to the main body portion when said door portion is in the closed position.

35. The invention as in claim 34 wherein the slider member has a first gap when the door portion is in the open position, said first gap is large enough to receive the fastening strips.

36. The invention as in claim 35 wherein the fastening strips have a width and the slider member has a second gap when the door portion is in the closed position, said second gap is less than the width of the fastening strips.

37. The invention as in claim 34 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

38. The invention as in claim 34 wherein the main body portion includes a transverse body segment arranged substantially perpendicular to the maim body portion and having a pair of downwardly extending side members with an opening therebetween, the opening being sized to receive the interlocking fastening strips.

39. The invention as in claim 38 wherein the first side surface is adjacent to the main body portion and the second side surface is adjacent to said transverse body segment when said door portion is in the closed position.

40. The invention as in claim 38 wherein said slider member includes it second transverse body segment.

41. The invention is in claim 40 wherein said first transverse body segment being arranged at a first end of the main body portion and said second transverse body segment is at a second end of the main body portion.

42. The invention as in claim 34 wherein said slider member includes a second door portion, said second door portion including a first side surface, a second side surface, and a shoulder at a lower end of the first side surface.

43. The invention as in claim 34 wherein said slider member includes a second door portion, a third door portion and a fourth door portion, each of said door portions including a side surface and a shoulder at a lower end of the side surface.

44. The invention as in claim 34, wherein the main body portion includes a downwardly extending side leg segment disposed along a side thereof and a transverse body segment disposed at art end thereof, the side leg segment having a shoulder at a lower end thereof and the transverse body segment having a pair of spaced-apart side members with an opening therebetween.

45. The invention as in claim 34 wherein the slider member further includes a latching mechanism for retaining said door portion in the closed position.

46. A storage container comprising:

a pair of complementary sheets;

a first fastening strip disposed along an edge portion of one sheet;

a second fastening strip disposed along an edge portion of the other sheet and disposed to interlockingly engage the first fastening strip; and a slider member slidably disposed on tire first and second fastening strips, the slider member facilitating the occlusion of the interlocking fastening strips when moved towards a first end thereof, the slider member including a main body portion and a door portion which is hingedly attached to the main body portion along a hinge portion for movement between open and closed positions, the hinge portion being substantially perpendicular to the interlocking fastening strips when the main body portion is installed upon the fastening strips, the door portion of the slider member includes a first side surface, a second side surface, and a shoulder disposed at a lower end of the first side surface, the first side surface is spaced-apart front the main body portion when said door portion is in the open position and is adjacent to the main body portion when said door portion is in the closed position.

47. The invention as in claim 46 wherein the slider member has a first gap when the door portion is in the open position, said first gap is large enough to receive the fastening strips.

48. The invention as in claim 47 wherein the fastening strips have a width and the slider member has a second gap when the door portion is in the closed position, said second gap is less than the width of the fastening strips.

49. The invention as in claim 46 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

50. The invention as in claim 46 wherein the main body portion includes a transverse body segment arranged substantially perpendicular to the main body portion and having a pair of downwardly extending side members with an opening therebetween, the opening being sized to receive the interlocking fastening strips.

51. The invention as in claim 50 wherein the first side surface is adjacent to the main body portion and the second side surface is adjacent to said transverse body segment when said door portion is in the closed position.

52. The invention as in claim 50 wherein said slider member includes a second transverse body segment.

53. The invention as in claim 52 wherein said first transverse body segment being arranged at a first end of the main body portion and said second transverse body segment is at a second end of the main body portion.

54. The invention as in claim 46 wherein said slider member includes a second door portion, said second door portion including a first side surface, a second side surface, and a shoulder at a lower end of the first side surface.

55. The invention as in claim 46 wherein said slider member includes a second door portion, a third door portion and a fourth door portion, each of said door portions including a side surface and a shoulder at a lower end of the side surface.

56. The invention as in claim 46, wherein the main body portion includes a downwardly extending side lag segment disposed along a side thereof and a transverse body segment disposed at an end thereof, the side leg segment having a shoulder at a lower end thereof and the transverse body segment having a pair of spaced-apart side members with an opening therebetween.

57. The invention as in claim 46 wherein the slider member farther includes a latching mechanism for retaining said door portion in the closed position.

58. The invention as in claim 46 wherein the interlocking fastening strips comprise U-channel type fastening strips.

59. The invention as in claim 46 wherein the interlocking fastening strips comprise shear action fastening strips.

60. The invention as in claim 46 wherein the interlocking fastening snips comprise arrowhead-type fastening strips.

61. The invention as in claim 46 wherein the interlocking fastening strips comprise rolling action fastening snips.

62. The invention as in claim 46 wherein the interlocking fastening strips comprise profile fastening strips.

63. A method for manufacturing a closure device comprising the steps of:

providing interlocking fastening strips;

providing a slider member including a main body portion and a door portion which is hingedly attached to the main body portion along a hinge portion for movement between open and closed positions, the hinge portion being substantially perpendicular to the interlocking fastening strips when the main body portion is installed upon the fastening strips; and positioning the slider member on the interlocking fastening strips when the door portion is in the open position and closing the door portion after the slider member is on the interlock lag fastening strips, the slider member is slidably disposed on the interlocking fastening snips, the slider member facilitating the occlusion of the interlocking fastening strips when moved towards a first end thereof, the door portion of the slider member includes a first side surface, a second side surface, and a shoulder disposed at a lower end of the first side surface, the first side surface is spaced-apart from the main body portion when said door portion is in the open position and is adjacent to the main body portion when said door portion is in the closed position.

64. The invention as in claim 63 wherein the slider member has a first gap when the door portion is in the open position, said first gap is large enough to receive the fastening strips.

65. The invention as in claim 64 wherein the fastening strips have a width and the slider member has a second gap when the door portion is in the closed position, said second gap is less than the width of the fastening strips.

66. The invention as in claim 63 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

67. The invention as in claim 63 wherein the main body portion includes a transverse body segment arranged substantially perpendicular to the main body portion and having a pair of downwardly extending side members with an opening therebetween, the opening being sized to receive the interlocking fastening strips.

68. The invention as in claim 67 wherein the first side surface is adjacent to the main body portion and the second side surface is adjacent to said transverse body segment when said door portion is in the closed position.

69. The invention as in claim 67 wherein said slider member includes a second transverse body segment.

70. The invention as in claim 69 wherein said first transverse body segment being arranged at a first end of the main body portion and said second transverse body segment is at a second end of the main body portion.

71. The invention as in claim 63 wherein said slider member includes a second door portion, said second door portion including a first side surface, a second side surface, and a shoulder at a lower end of the first side surface.

72. The invention as in claim 63 wherein said slider member includes a second door portion, a third door portion and a fourth door portion, each of said door portions including a side surface and a shoulder at a lower end of the side surface.

73. The invention as in claim 63, wherein the main body portion includes a downwardly extending side leg segment disposed along a side thereof and a transverse body segment disposed at an end thereof the side leg segment having a shoulder at a lower end thereof and the transverse body segment having a pair of spaced-apart side members with an opening therebetween.

74. The invention as in claim 63 wherein the slider member further includes a latching mechanism for retaining said door portion in the closed position.

75. The invention as in claim 63 wherein the interlocking fastening strips comprise U-channel type fastening strips.

76. The invention as in claim 63 wherein the interlocking fastening strips comprise shear action fastening strips.

77. The invention as in claim 63 wherein the interlocking fastening strips comprise arrowhead-type fastening strips.

78. The invention as in claim 63 wherein the interlocking fastening strips comprise rolling action fastening strips.

79. The invention as in claim 63 wherein the interlocking fastening strips comprise profile fastening strips.

80. A closure device comprising:

interlocking fastening strips; and a slider member slidably disposed on the interlocking fastening strips, the slider member facilitating the occlusion of the interlocking fastening strips when moved towards a first end thereof, the slider member including a main body portion and a door portion which is hingedly attached to the main body portion along a hinge portion for movement between open and closed positions, the hinge portion being substantially perpendicular to the interlocking fastening strips when the main body portion is installed upon the fastening strips, the door portion of the slider member includes a first side surface, a second side surface, and a shoulder disposed at a lower end of the first side surface, the main body portion includes a transverse body segment arranged substantially perpendicular to the main body portion and having a pair of downwardly extending side members with an opening therebetween, the opening being sized to receive the interlocking fastening strips.

81. The invention as in claim 80 wherein the slider member has a first gap when the door portion is in the open position, said first gap is large enough to receive the fastening strips.

82. The invention as in claim 81 wherein the fastening strips have a width and the slider member has a second gap when the door portion is in the closed position, said second gap is less than the width of the fastening strips.

83. The invention as in claim 80 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

84. The invention as in claim 80 wherein the first side surface is adjacent to the main body portion and the second side surface is adjacent to said transverse body segment wheat said door portion is in the closed position.

85. The invention as in claim 80 wherein said slider member includes a second door portion, said second door portion including a first side surface, a second side surface, and a shoulder at a lower end of the first side surface.

86. The invention as in claim 85 wherein each of said door portions includes a notch which is proximal to its hinge portion.

87. The invention as in claim 86 wherein the notches provide a first gap between the door portions when in the open position, said first gap is large enough to receive the interlocking fastening strips.

88. The invention as in claim 80 wherein said slider member includes a second door portion, a third door portion and a fourth door portion, each of said door portions including a side surface and a shoulder at a lower end of the side surface.

89. The invention as in claim 80 wherein said slider member includes a second transverse body segment.

90. The invention as in claim 89 wherein said first transverse body segment being arranged at a first end of the main body portion and said second transverse body segment is at a second end of the main body portion.

91. The invention as in claim 89 wherein said slider member includes a second door portion, a third door portion and a fourth door portion, each door portion including a first side surface, a second side surface, and a shoulder at a lower end of the first side surface.

92. The invention as in claim 80, wherein the main body portion includes a downwardly extending side leg segment disposed along a side thereof, the side leg segment having a shoulder at a lower end thereof.

93. The invention as in claim 92 wherein the door portion includes a notch which is proximal to its hinge portion.

94. The invention as in claim 92 wherein the shoulder of the side surface and the shoulder of the leg segment are separated by a second gap when the door portion is in the closed position, the second gap being less than the width of the interlocking fastening strips.

95. The invention as in claim 80 wherein the slider member further includes mechanism for retaining said door portion in the closed position.

96. The invention as in claim 95 wherein the latching mechanism comprises an appendage projecting outwardly from said door portion and a cooperating notch formed in the main body portion, the appendage having a barb at its distal end, the notch of the latching mechanism capturing the barb of the latching mechanism when said door portion is moved into the closed position.

97. The invention as in claim 80 wherein the slider member further includes a latching mechanism for retaining said door portion in the closed position.

98. The invention as in claim 97 wherein the latching mechanism comprises a protuberance formed along said transverse body segment of the main body portion and a cooperating chamfer farmed along an edge of said door portion, the protuberance of the latching mechanism interlockingly engaging the chamfer of the latching mechanism when said door portion is moved into the closed position.

99. The invention as in claim 97 wherein the latching mechanism comprises a generally arcuate appendage projecting outwardly from said door portion and a generally arcuate cooperating slot formed in said transverse body segment of the main body portion, the slot of the latching mechanism having a first notch formed along its length and the appendage of the latching mechanism having a first barb formed along its length, the slot of the latching mechanism receiving the appendage of the latching mechanism when said door portion is moved toward the closed position while said first barb of the appendage interacts with said first notch of the slot to provide a first assembly position for said door portion.

100. The invention as in claim 99 wherein said slot includes a second notch and said first barb interacts with said second notch to provide a second assembly position for said door portion.

101. The invention as in claim 100 wherein said second assembly position is an open position.

102. The invention as in claim 99 wherein said first assembly position is a closed position.

103. The invention as in claim 80 wherein the interlocking fastening strips comprise U-channel type fastening strips.

104. The invention as in claim 80 wherein the interlocking fastening strips comprise shear action fastening strips.

105. The invention as in claim 80 wherein the interlocking fastening strips comprise arrowhead-type fastening strips.

106. The invention as in claim 80 wherein the interlocking fastening strips comprise rolling action fastening strips.

107. The invention as in claim 80 wherein the interlocking fastening strips comprise profile fastening strips.

108. A slider member adapted to facilitate the occlusion of interlocking fastening strips, the slider member comprising:

a main body portion which is adapted to be installed upon the interlocking fastening strips; and a door portion which is hingedly attached to the main body portion along a hinge portion for movement between open and closed positions, the hinge portion being substantially perpendicular to the interlocking fastening strips when the main body portion is installed upon the fastening strips, the door portion of the slider member includes a first side surface, a second side surface, and a shoulder disposed at a lower end of the first side surface, the main body portion includes a transverse body segment arranged substantially perpendicular to the main body portion and having a pair of downwardly extending side members with an opening therebetween, the opening being sized to receive the interlocking fastening strips.

109. The invention as in claim 108 wherein the slider member has a first gap when the door portion is in the open position, said first gap is large enough to receive the fastening strips.

110. The invention as in claim 109 wherein the fastening strips have a width and the slider member has a second gap when the door portion is in the closed position, said second gap is less than the width of the fastening strips.

111. The invention as in claim 108 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

112. The invention as in claim 108 wherein the first side surface is adjacent to the main body portion end the second side surface is adjacent to said transverse body segment when said door portion is in the closed position.

113. The invention as in claim 108 wherein said slider member includes a second door portion, said second door portion including a first side surface, a second side surface, and a shoulder at a lower end of the first side surface.

114. The invention as in claim 108 wherein said slider member includes a second door portion, a third door portion and a fourth door portion, each of said door portions including a side surface and a shoulder at a lower end of the side surface.

115. The invention as in claim 108 wherein said slider member includes a second transverse body segment.

116. The invention as in claim 115 wherein said first transverse body segment being arranged at a first end of the main body portion and said second transverse body segment is at a second end of the main body portion.

117. The invention as in claim 108, wherein the main body portion includes a downwardly extending side leg segment disposed along a side thereof.

118. The invention as in claim 108 wherein the slider member further includes a latching mechanism for retaining said door portion in the closed position.

119. A storage container comprising:

a pair of complementary sheets;

a first fastening strip disposed along an edge portion of one sheet;

a second fastening strip disposed along an edge portion of the other sheet and disposed to interlockingly engage the first fastening strip; and a slider member slidably disposed on the first and second fastening strips, the slider member facilitating the occlusion of the interlocking fastening strips when moved towards a first end thereof the slider member including a main body portion and a door portion which is hingedly attached to the main body portion along a hinge portion for movement between open and closed positions, the hinge portion being substantially perpendicular to the interlocking fastening strips when the main body portion is installed upon the fastening strips, the door portion of the slider member includes a first side surface, a second side surface, and a shoulder disposed at a lower end of the first side surface, the main body portion includes a transverse body segment arranged substantially perpendicular to the main body portion and having a pair of downwardly extending side members with an opening therebetween, the opening being sized to receive the interlocking fastening strips.

120. The invention as in claim 119 wherein the slider member has a first gap when the door portion is in the open position, said first gap is large enough to receive the fastening strips.

121. The invention as in claim 120 wherein the fastening strips have a width and the slider member has a second gap when the door portion is in the closed position, said second gap is less than the width of the fastening strips.

122. The invention as in claim 119 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

123. The invention as in claim 119 wherein the first side surface is adjacent to the main body portion and the second side surface is adjacent to said transverse body segment when said door portion is in the closed position.

124. The invention as in claim 119 wherein said slider member includes a second door portion, said second door portion including a first side surface, a second side surface, and a shoulder at a lower end of the first side surface.

125. The invention as in claim 119 wherein said slider member includes a second door portion, a third door portion and a fourth door portion, each of said door portions including a side surface and a shoulder at a lower end of the side surface.

126. The invention as an claim 119 wherein said slider member includes a second transverse body segment.

127. The invention as in claim 126 wherein said first transverse body segment being arranged at a first end of the main body portion and said second transverse body segment is at a second end of the main body portion.

128. The invention as in claim 119, wherein the main body portion includes a downwardly extending side leg segment disposed along a side thereof, the side leg sapient having a shoulder at a lower end thereof.

129. The invention as in claim 119 wherein the slider member further includes a latching mechanism for retaining said door portion in the closed position.

130. A method for manufacturing a closure device comprising the steps of:

providing interlocking fastening strips;

providing a slider member including a main body portion end a door portion which is hingedly attached to the main body portion along a hinge portion for movement between open and closed positions, the binge portion being substantially perpendicular to the interlocking fastening strips when the main body portion is installed upon the fastening strips; and positioning the slider member on the interlocking fastening strips when the door portion is in the open position and closing the door portion after the slider member is on the interlocking fastening strips, the slider member is slidably disposed on the interlocking fastening strips, the slider member facilitating the occlusion of the interlocking fastening strips when moved towards a first end thereof, the door portion of the slider member includes a first side surface, a second side surface, and a shoulder disposed at a lower end of the first side surface, the main body portion includes a transverse body segment arranged substantially perpendicular to the main body portion and having a pair of downwardly extending side members with an opening therebetween, the opening being sized to receive the interlocking fastening strips.

131. The invention as in claim 130, wherein the slider member has a first gap when the door portion is in the open position, said first gap is large enough to receive the fastening strips.

132. The invention as is claim 131 wherein the fastening strips have a width and the slider member has a second gap when the door portion is in the closed position, said second gap is less than the width of the fastening strips.

133. The invention as in claim 130 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

134. The invention as in claim 130 wherein the first side surface is adjacent to the main body portion and the second side surface is adjacent to said transverse body segment when said door portion is in the closed position.

135. The invention as in claim 130 wherein said slider member includes a second door portion, said second door portion including a first side surface, a second side surface, and a shoulder at a lower end of the first side surface.

136. The invention as in claim 130 wherein said slider member includes a second door portion, a third door portion and a fourth door portion, each of said door portions including a side surface and a shoulder at a lower end of the side surface.

137. The invention as in claim 130 wherein said slider member includes a second transverse body segment.

138. The invention as in claim 137 wherein said first transverse body segment being arranged at a first end of the main body portion and said second transverse body segment is at a second end of the main body portion.

139. The invention as in claim 130, wherein the main body portion includes a downwardly extending side leg segment disposed along a side thereof, the side leg segment having a shoulder at a lower end thereof.

140. The invention as in claim 130 wherein the slider member further includes a latching mechanism for retaining said door portion in the closed position.

141. A closure device comprising:

interlocking fastening strips; and a slider member slidably disposed on the interlocking fastening strips, the slider member facilitating the occlusion of the interlocking fastening strips when moved towards a first end thereof, the slider member including a main body portion and a door portion which is hingedly attached to the main body portion along a hinge portion for movement between open and closed positions, the hinge portion being substantially perpendicular to the interlocking fastening strips when the main body portion is installed upon the fastening strips, the door portion of the slider member includes a first side surface, a second side surface, and a shoulder disposed at a lower end of the first side surface, the main body portion includes a downwardly extending side leg segment disposed along a side thereof and a transverse body segment disposed at an end thereof, the side leg segment having a shoulder at a lower end thereof and the transverse body segment having a pair of spaced-apart side members with an opening therebetween.

142. The invention as in claim 141 wherein the slider member has a first gap when the door portion is in the open position, said first gap is large enough to receive the fastening strips.

143. The invention as in claim 142 wherein the fastening strips have a width and the slider member has a second gap when the door portion is in the closed position, said second gap is less than the width of the fastening strips.

144. The invention as in claim 141 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

145. The invention as in claim 141 wherein the first side surface is adjacent to the main body portion and the second side surface is adjacent to said transverse body segment when said door portion is in the closed position.

146. The invention as in claim 141 wherein the door portion includes a notch which is proximal to its hinge portion.

147. The invention as in claim 146 wherein the notch of the door portion and the side leg segment of the main body portion are separated by a first gap when the door portion is in the open position, the first gap being large enough to receive the interlocking fastening strips.

148. The invention as in claim 141 wherein the shoulder of the side surface and the shoulder of the leg segment are separated by a second gap when the door portion is in the closed position, the second gap being less than the width of the interlocking fastening strips.

149. The invention as in claim 141 wherein the slider member further includes a latching mechanism for retaining said door portion in the closed position.

150. The invention as in claim 149 wherein the latching mechanism comprises an appendage projecting outwardly from said door portion and a cooperating notch formed in the main body portion, the appendage having a barb at its distal end, the notch of the latching mechanism capturing the barb of the latching mechanism when said door portion is moved into the closed position.

151. The invention as in claim 149 wherein the latching mechanism comprises a protuberance formed along said transverse body segment of the main body portion and a cooperating chamber formed along an edge of said door portion, the protuberance of the latching mechanism interlockingly engaging the chamfer of the latching mechanism when said door portion is moved into the closed position.

152. The invention as in claim 149 wherein the latching mechanism comprises a generally arcuate appendage projecting outwardly from said door portion and a generally arcuate cooperating slot formed in said transverse body segment of the main body portion, the slot of the latching mechanism having a first notch formed along its length and the appendage of the latching mechanism having a first barb formed along its length, the slot of the latching mechanism receiving the appendage of the latching mechanism when said door portion is moved toward the closed position while said first barb of the appendage interacts with said first notch of the slot to provide a first assembly position for said door portion.

153. The invention as in claim 152 wherein said slot includes a second notch and said first barb interacts with said second notch to provide a second assembly position for said door portion.

154. The invention as in claim 153 wherein said second assembly position is an open position.

155. The invention as in claim 153 wherein said appendage having a second barb and said second barb interacts with mid second notch in said second assembly position.

156. The invention as in claim 152 wherein said first assembly position is a closed position.

157. The invention as in claim 141 wherein the interlocking fastening strips comprise U-channel type fastening strips.

158. The invention as in claim 141 wherein the interlocking fastening strips comprise shear action fastening strips.

159. The invention as in claim 141 wherein the interlocking fastening strips comprise arrowhead-type fastening strips.

160. The invention as in claim 141 wherein the interlocking fastening strips comprise rolling action fastening strips.

161. The invention as in claim 141 wherein the interlocking fastening strips comprise profile fastening strips.

162. A slider member adapted to facilitate the occlusion of interlocking fastening strips, the slider member comprising:

a main body portion which is adapted to be installed upon the interlocking fastening strips; and a door portion which is hingedly attached to the main body portion along a hinge portion for movement between open and closed positions, the hinge portion being substantially perpendicular to the interlocking fastening strips when the main body portion is installed upon the fastening strips, the door portion of the slider member includes a first side surface, a second side surface, and a shoulder disposed at a lower end of the first side surface, the main body portion includes a downwardly extending side leg segment disposed along a side thereof and transverse body segment disposed at an end thereof, the side leg segment having a shoulder at a lower end thereof and the transverse body segment having a pair of spaced-apart side members with an opening therebetween.

163. The invention as in claim 162 wherein the slider member has a first gap when the door portion as in the open position, said first gap is large enough to receive the fastening strips.

164. The invention as in claim 163 wherein the fastening strips have a width and the slider member has a second gap when the door portion is in the closed position, said second gap is less than the width of the fastening strips.

165. The invention as in claim 162 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

166. The invention as in claim 162 wherein the first side surface is adjacent to the main body portion and the second side surface is adjacent to said transverse body segment when said door portion is in the closed position.

167. The invention as in claim 162 wherein the slider member further includes a latching mechanism for retaining said door portion in the closed position.

168. A storage container comprising:

a pair of complementary sheets;

a first fastening strip disposed along an edge portion of one sheet;

a second fastening strip disposed along an edge portion of the other sheet and disposed to interlockingly engage the first fastening strip; and a slider member slidably disposed on the first and second fastening strips, the slider member facilitating the occlusion of the interlocking fastening strips when moved towards a first end thereof, the slider member including a main body portion and a door portion which is hingedly attached to the main body portion along a hinge portion for movement between open and closed positions, the hinge portion being substantially perpendicular to the interlocking fastening strips when the main body portion is installed upon the fastening strips, the door portion of the slider member includes a first side surface, a second side surface, and a shoulder disposed at a lower end of the first side surface, the main body portion includes a downwardly extending side leg segment disposed along a side thereof and a transverse body segment disposed at an end thereof, the side leg segment having a shoulder at a lower end thereof and the transverse body segment having a pair of spaced-apart side members with an opening therebetween.

169. The invention as in claim 168 wherein the slider member has a first gap when the door portion is in the open position, said first gap is large enough to receive the fastening strips.

170. The invention as in claim 169 wherein the fastening strips have a width and the slider member has a second gap when the door portion is in the closed position, said second gap is less than the width of the fastening strips.

171. The invention as in claim 168 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

172. The invention as in claim 168 wherein the first side surface is adjacent to the main body portion and the second side surface is adjacent to said transverse body segment when said door portion is in the closed position.

173. The invention as in claim 168 wherein the slider member further includes a latching mechanism for retaining said door portion in the closed position.

174. A method for manufacturing a closure device comprising the steps of:

providing interlocking fastening strips;

providing a slider member including a main body portion and a door portion which is hingedly attached to the main body portion along a hinge portion for movement between open and closed positions, the hinge portion being substantially perpendicular to the interlocking fastening strips when the main body portion is installed upon the fastening strips; and positioning the slider member on the interlocking fastening strips when the door portion is in the open position and closing the door portion after the slider member is on the interlocking fastening strips, the slider member is slidably disposed on the interlocking fastening strips, the slider member facilitating the occlusion of the interlocking fastening strips when moved towards a first end thereof, the door portion of the slider member includes a first side surface, a second side surface, and a shoulder disposed at a lower end of the first side surface, the main body portion includes a downwardly extending side leg segment disposed along a side thereof and a transverse body segment disposed at an end thereof, the side leg segment having a shoulder at a lower end thereof and the transverse body segment having a pair of spaced-apart side members with an opening therebetween.

175. The invention as in claim 174 wherein the slider member has a first gap when the door portion is in the open position, said first gap is large enough to receive the fastening strips.

176. The invention as in claim 175 wherein the fastening strips have a width and the slider member has a second gap when the door portion is in the closed position, said second gap is less than the width of the fastening strips.

177. The invention as in claim 174 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

178. The invention as in claim 174 wherein the first side surface is adjacent to the main body portion and the second side surface is adjacent to said transverse body segment when said door portion is in the closed position.

179. The invention as in claim 174 wherein the slider member further includes a latching mechanism for retaining said door portion in the closed position.

180. A closure device comprising:

interlocking fastening strips; and a slider member slidably disposed on the interlocking fastening strips, the slider member facilitating the occlusion of the interlocking fastening strips when moved towards a first end thereof, the slider member including a main body portion and a door portion which is hingedly attached to the main body portion along a hinge portion for movement between open and closed positions, the hinge portion being substantially perpendicular to the interlocking fastening strips when the main body portion is instilled upon the fastening strips, the slider member further includes a latching mechanism for retaining said door portion in the closed position, the latching mechanism is integral with the slider member.

181. The invention as in claim 180 wherein the slider member has a first gap when the door portion is in the open position, said first gap is large enough to receive the fastening strips.

182. The invention as in claim 181 wherein the fastening strips have a width and the slider member has a second gap when the door portion is in the closed position, said second gap is less than the width of the fastening strips.

183. The invention as in claim 180 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

184. The invention as in claim 180 wherein the door portion of the slider member includes a first side surface, a second side surface, and a shoulder disposed at a lower end of the first side surface.

185. The invention as in claim 180 wherein the latching mechanism comprises an appendage projecting outwardly from said door portion and a cooperating notch formed in the main body portion, the appendage having a barb at its distal end, the notch of the latching mechanism capturing the barb of the latching mechanism when said door portion is moved into the closed position.

186. The invention as in claim 180 wherein the main body portion includes a transverse body segment.

187. The invention as in claim 186 wherein the latching mechanism comprises a protuberance formed along said transverse body segment of the main body portion and a cooperating chamfer formed along am edge of said door portion, the protuberance of the latching mechanism interlockingly engaging the chamfer of the latching mechanism when said door portion is moved into the closed position.

188. The invention as in claim 186 wherein the latching mechanism comprises a generally accurate appendage projecting outwardly from said door portion and a generally arcuate cooperating slot formed in said transverse body segment of the main body portion, the slot of thin latching mechanism having a firm notch formed along its length and the appendage of the latching mechanism having a first barb formed along its length, the slot of the latching mechanism receiving the appendage of the latching mechanism when said door portion is moved toward the closed position while said first barb of the appendage interacts with said first notch of the slot to provide a first assembly position for said door portion.

189. The invention as in claim 188 wherein said slot includes a second notch and said first barb interacts with said second notch to provide a second assembly position for said door portion.

190. The invention as in claim 189 wherein said second assembly position is an open position.

191. The invention as in claim 189 wherein said appendage having a second barb and said second barb interacts with said second notch in said second assembly position.

192. The invention as in claim 188 wherein said first assembly position is a closed position.

193. The invention as in claim 180 wherein the interlocking fastening strips comprise U-channel type fastening strips.

194. The invention as in claim 180 wherein the interlocking fastening strips comprise shear action fastening strips.

195. The invention as in claim 180 wherein the interlocking fastening strips comprise arrowhead-type fastening strips.

196. The invention as in claim 180 wherein the interlocking fastening strips comprise rolling action fastening strips.

197. The invention as in claim 180 wherein the interlocking fastening strips comprise profile fastening strips.

198. A slider member adapted to facilitate the occlusion of interlocking fastening strips, the slider member comprising:

a main body portion which is adapted to be installed upon the interlocking fastening strips; and a door portion which is hingedly attached to the main body portion along a hinge portion for movement between open and closed positions, the hinge portion being substantially perpendicular to the interlocking fastening strips when the main body portion is installed upon the fastening strips, the slider member further includes a latching mechanism for retaining said door portion in the closed position, the latching mechanism is integral with the slider member.

199. The invention as in claim 198 wherein the slider member has a first gap when the door portion is in the open position, said first gap is large enough to receive the fastening strips.

200. The invention as in claim 199 wherein the fastening strips have a width and the slider member has a second gap when the door portion is in the closed position, said second gap is less than the width of the fastening strips.

201. The invention as in claim 198 wherein the fastening strips have a longitudinal X axis, Y axis which is perpendicular to the X axis and a Z axis which is perpendicular to the X axis and the Y axis, the main body portion is parallel to the X axis, and the hinge portion is parallel to the Z axis.

202. The invention as in claim 198 wherein the door portion of the slider member includes a first side surface, a second side surface, and a shoulder disposed at a lower end of the first side surface.

203. The invention as in claim 198 wherein the latching mechanism comprises an appendage projecting outwardly from said door portion and a cooperating notch formed in the main body portion, the appendage having a barb at its distal end, the notch of the latching mechanism capturing the barb of the latching mechanism when said door portion is moved into the closed position.

204. The invention as in claim 198 wherein the main body portion includes a transverse body segment.

205. The invention as in claim 204 wherein the latching mechanism comprises a protuberance formed along said transverse body segment of the main body portion and a cooperating chamfer formed along an edge of said door portion, the protuberance of the latching mechanism interlockingly engaging the chamfer of the latching mechanism when said door portion is moved into the closed position.

206. The invention as in claim 204 wherein the latching mechanism comprises a generally arcuate appendage projecting outwardly from said door portion and a generally arcuate cooperating slot formed in said transverse body segment of the main body portion, the slot of the latching mechanism having a first notch formed along its length and the appendage of the latching mechanism having a first barb formed along its length, the slot oldie latching mechanism receiving the appendage of the latching mechanism when said door portion is moved toward the closed position while said first barb of the appendage interacts with said first match of the slot to provide a first assembly position for said door portion.

207. The invention as in claim 206 wherein said slot includes a second notch and mid first barb interacts with said second notch to provide a second assembly position for said door.

208. The invention as in claim 207 wherein said second assembly position is an open position.

209. The invention as in claim 207 wherein said appendage having a second barb and said second barb interacts with said second notch in said second assembly position.

210. The invention as in claim 206 wherein said first assembly position is a closed position.

211. The invention as in claim 198 wherein the interlocking fastening strips comprise U-channel type fastening strips.

212. The invention as in claim 198 wherein the interlocking fastening strips comprise shear action fastening strips.

213. The invention as in claim 198 wherein the interlocking fastening strips comprise arrowhead-type fastening strips.

214. The invention as in claim 198 wherein the interlocking fastening strips comprise rolling action fastening strips.

215. The invention as in claim 198 wherein the interlocking fastening strips comprise profile fastening strips.

216. A storage container comprising:

a pair of complementary sheets;

a first fastening strip disposed along an edge portion of one sheet;

a second fastening strip disposed along an edge portion of the other sheet and disposed to interlockingly engage the first fastening strip; and a slider member slidably disposed on the first and second fastening strips, the slider member facilitating the occlusion of the interlocking fastening strips when moved towards a first end thereof, the slider member including a main body portion and a door portion which is hingedly attached to the main body portion along a hinge portion for movement between open and closed positions, the hinge portion being substantially perpendicular to the interlocking fastening strips when the main body portion is installed upon the fastening strips, the slider member further includes a latching mechanism for retaining said door portion in the closed position, the latching mechanism is integral with the slider member.

217. The invention as in claim 216 wherein the slider member has a first gap when the door portion is in the open position, said first gap is large enough to receive the fastening strips.

218. The invention as in claim 217 wherein the fastening strips have a width and the slider member has a second gap when the door portion is in the closed position, said second gap is less than the width of the fastening strips.

219. The invention as in claim 216 wherein the fastening strips have a longitudinal X axis, a Y axis which is perpendicular to the X axis and a Z axis which is perpendicular to the X axis and the Y axis; the main body portion is parallel to the X axis, and the hinge portion is parallel to the Z axis.

220. Invention as in claim 216 wherein the door portion of the slider a surface, second side surface, a shoulder disposed at a lower end of the first side surface.

221. The invention as in claim 216 wherein the latching mechanism comprises an appendage projecting outwardly from said door portion and a cooperating notch formed in the main body portion, the appendage having a barb at its distal end, the notch of the latching mechanism capturing the barb of the latching mechanism when mid door portion is moved into the closed position.

222. The invention as in claim 216 wherein the main body portion includes a transverse body segment.

223. The invention as in claim 222 wherein the latching mechanism comprises a protuberance formed along said transverse body segment of the main body portion and a cooperating chamfer formed along an edge of said door portion, the protuberance of the latching mechanism interlockingly engaging the chamfer of the latching mechanism when said door portion is moved into the closed position.

224. The invention as in claim 222 wherein the latching mechanism comprises a generally arcuate appendage projecting outwardly from said door portion and a generally arcuate cooperating slot formed in said transverse body segment of the main body portion, the slot of the latching mechanism having a first notch formed along its length and the appendage of the latching mechanism having a first barb formed along its length, the slat of the latching mechanism receiving the appendage of the latching mechanism when said door portion is moved toward the closed position white said first barb of the appendage interacts with said first notch of the slot to provide a first assembly position for said door portion.

225. The invention as in claim 224 wherein said slot includes a second notch and said first barb interacts with said second notch to provide a second assembly position for said door portion.

226. The invention as in claim 225 wherein said second assembly position is an open position.

227. The invention as in claim 225 wherein said appendage having a second barb and said second barb interacts with said second notch in said second assembly position.

228. The invention as in claim 224 wherein said first assembly position is a closed position.

229. The invention as in claim 216 wherein the interlocking fastening strips comprise U-channel type fastening strips.

230. The invention as in claim 216 wherein the interlocking fastening strips comprise shear action fastening strips.

231. The invention as in claim 216 wherein the interlocking fastening strips comprise arrowhead-type fastening strips.

232. The invention as in claim 216 wherein the interlocking fastening strips comprise rolling action type fastening strips.

233. The invention as in claim 216 wherein the interlocking fastening strips comprise profile fastening strips.

234. A method for manufacturing a closure device comprising the steps of:

providing interlocking fastening strips;

providing a slider member including a main body portion and a door portion which is hingedly attached to the main body portion along a hinge portion for movement between open and closed positions, the hinge portion being substantially perpendicular to the interlocking fastening strips when the main body portion is installed upon the fastening strips; and positioning the slider member on the interlocking fastening strips when the door portion is in the open position and closing the door portion after the slider member is on the interlocking fastening strips, the slider member is audibly disposed on the interlocking fastening strips, the slider member facilitating the occlusion of the interlocking fastening when moved towards a first end thereof the slider member further includes a latching mechanism for retaining said door portion in the closed position, the latching mechanism is integral with the slider member.

235. The invention as in claim 234 wherein the slider member has a first gap when the door portion is in the open position, said first gap is large enough to receive the fastening strips.

236. The invention as in claim 235 wherein the fastening strips have a width and the slider member has a second gap when the door portion is in the closed position, said second gap is less than the width of the fastening strips.

237. The invention as in claim 234 wherein the fastening strips have a longitudinal X axis, a Y axis which is perpendicular to the X axis and a Z axis which is perpendicular to the X axis and the Y axis, the main body portion is parallel to the X axis, and the hinge portion is parallel to the Z axis.

238. The invention as in claim 234 wherein the door portion of the slider member includes a first side surface, a second side surface, and a shoulder disposed at a lower end of the first side surface.

239. The invention as in claim 234 wherein the latching mechanism comprises an appendage projecting outwardly from said door portion and a cooperating notch formed in the main body portion, the appendage having a barb at its distal end, the notch of the latching mechanism capturing the barb of the latching mechanism when said door portion is moved into the closed position.

240. The invention as in claim 234 wherein the main body portion includes a transverse body segment.

241. The invention as in claim 240 wherein the latching mechanism comprises a protuberance formed along said transverse body segment of the main body portion and a cooperating chamfer formed along an edge of said door portion, the protuberance of the latching mechanism interlockingly engaging the chamfer of the latching mechanism when said door portion is moved into the closed position.

242. The invention as in claim 240 wherein the latching mechanism comprises a generally arcuate appendage projecting outwardly from said door portion and a generally arcuate cooperating slot formed in said transverse body segment of the main body portion, the slot of the latching mechanism having a first notch formed along its length and the appendage of the latching mechanism having a first barb formed along its length, the slot of the latching mechanism receiving the appendage of the latching mechanism when said door portion is moved toward the closed position while said first barb of the appendage interacts with said first notch of the slot to provide a first assembly position for said door portion.

243. The invention as in claim 242 wherein said slot includes a second notch and said first barb interacts with said second notch to provide a second assembly position for said door portion.

244. The invention as in claim 243 wherein said second assembly position is an open position.

245. The invention as in claim 243 wherein said appendage having a second barb and said second barb interacts with said second notch in said second assembly position.

246. The invention as in claim 242 wherein said first assembly position is a closed position.

247. The invention as in claim 234 wherein the interlocking fastening strips comprise U-channel type fastening strips.

248. The invention as in claim 234 wherein the interlocking fastening strips comprise shear action fastening strips.

249. The invention as in claim 234 wherein the interlocking fastening strips comprise arrowhead-type fastening strips.

250. The invention as in claim 234 wherein the interlocking fastening strips comprise rolling action fastening strips.

251. The invention as in claim 234 wherein the interlocking fastening strips comprise profile fastening strips.

* * * * *